US008136612B2

(12) United States Patent
Carlson et al.

(10) Patent No.: US 8,136,612 B2
(45) Date of Patent: Mar. 20, 2012

(54) CONSTANT-MODE AUTO-DRILL WITH PRESSURE DERIVATIVE CONTROL

(75) Inventors: Robin W. Carlson, Pella, IA (US); Philip R. Lane, Pella, IA (US)

(73) Assignee: Vermeer Corporation, Pella, IA (US)

( * ) Notice: Subject to any disclaimer, the term of this patent is extended or adjusted under 35 U.S.C. 154(b) by 143 days.

(21) Appl. No.: 12/598,560

(22) PCT Filed: May 2, 2008

(86) PCT No.: PCT/US2008/005691

§ 371 (c)(1), (2), (4) Date: Nov. 2, 2009

(87) PCT Pub. No.: WO2008/137078

PCT Pub. Date: Nov. 13, 2008

(65) Prior Publication Data

US 2010/0133009 A1 Jun. 3, 2010

(51) Int. Cl.
*E21B 44/06* (2006.01)

(52) U.S. Cl. ..... 175/62; 175/40; 175/26

(58) Field of Classification Search ..... 175/61, 175/62, 40, 45, 24, 26
See application file for complete search history.

(56) References Cited

U.S. PATENT DOCUMENTS 5,746,278 A 5/1998 Bischel et al.
6,651,755 B1 11/2003 Kelpe
2001/0050186 A1 12/2001 Wilson et al.
2002/0195275 A1* 12/2002 Brand et al. ..... 175/24
2008/0110674 A1* 5/2008 Jones et al. ..... 175/25

FOREIGN PATENT DOCUMENTS

WO WO 97/49895 12/1997
WO WO 2006/108918 10/2006

OTHER PUBLICATIONS

The International Search Report and Written Opinion from International Patent Application No. PCT/US2008/005691 dated Aug. 29, 2008.

* cited by examiner

*Primary Examiner* — Kenneth L Thompson
(74) *Attorney, Agent, or Firm* — Hollingsworth & Funk, LLC

(57) ABSTRACT

Some embodiments of the invention concern HDD in an automatic drilling mode. Such embodiments can include maintaining a constant output parameter while performing a drilling operation using an HDD rig (20) having a thrust pump, generating hydraulic fluid pressure measurements from one or more pumps of the HDD rig, comparing the hydraulic fluid pressure measurements to a variable pressure limit, calculating a derivative value using the measured hydraulic fluid pressure measurements, comparing the derivative value to a derivative threshold, decreasing the variable pressure limit when the derivative value exceeds the derivative threshold, wherein the amount that the variable pressure limit is decreased is based on one or more of the hydraulic fluid pressure measurements, and reducing output of the thrust pump when the comparison of the hydraulic fluid pressure measurements to the variable pressure limit indicates that one or more of the hydraulic fluid pressure measurements exceed the variable pressure limit.

28 Claims, 13 Drawing Sheets

CONSTANT-MODE AUTO-DRILL WITH PRESSURE DERIVATIVE CONTROL

FIELD OF THE INVENTION

The present invention relates generally to underground boring machines and methods for controlling underground boring. More particularly, the present invention relates to underground boring machines for use in horizontal directional drilling and to an improved method of, and apparatus for, providing an automatic control mode for drilling using a pressure derivative.

BACKGROUND OF THE INVENTION

Utility lines for water, electricity, gas, telephone and cable television are often run underground for safety and aesthetics reasons, among others. Sometimes the underground utilities are buried in a trench that is then back filled. Trenching, however, can be time consuming and can cause substantial damage to existing structures or roadways. Consequently, horizontal directional drilling ("HDD") is often used to avoid these drawbacks.

A typical horizontal directional drilling machine includes a frame on which is mounted a rotational drive mechanism. The rotational drive mechanism can be slidably moved along the longitudinal axis of the frame, to rotate a drill string about its longitudinal axis while sliding along the frame to advance the drill sting into, or withdraw it from, the ground. The drill string comprises one or more drill rods attached together in a string.

A boring tool is installed onto the advancing end of the drill string (i.e., the end furthest away from the HDD machine). More specifically, a drill bit is used when the drill string is being advanced into the ground. On the other hand, a back reamer is used to enlarge a bored hole and is used when the drill string is being withdrawn after a hole is cut. Boring tools may include a wide variety of soil cutting devices tailored for specific formations. Examples include cutting edges that shear the soil and compression elements that concentrate longitudinal force from the drill string into a concentrated area to fracture the ground when boring in rock conditions.

Boring machines can include controls that allow the operator to control both the rotational movement and the longitudinal movement, longitudinal movement associated with thrust. The optimum setting of rotational movement and thrust movement depends on various factors such as the soil conditions, the formation, and the type of boring tool. The boring process generally requires maintaining consistent thrust pressures and at a low thrust speed control. In many systems, the software uses adjustable thrust and rotation pressure set-points. If either the thrust or rotation pressure exceeds its set-point, then the thrust/pullback speed may be manually reduced to control the pressure which has exceeded its set-point. This requires the operator to continuously monitor the pressure set-points and adjust them as drilling conditions change. Therefore, there exists a need in the art for a method and apparatus to automate portions of the drilling operation.

SUMMARY OF THE INVENTION

This invention includes a method and apparatus for use with a horizontal directional drilling (HDD) machine. A preferred manner in which the present invention may be implemented is in a controller for the hydraulic pump output(s) of an HDD machine. The invention provides an operator with an automated (e.g., a hands-off) control of thrust/pullback and rotation functions. A pressure derivative control function is used to monitor the thrust/pullback and rotation pressures while still allowing them to vary naturally as drilling conditions change.

In some embodiments of the present invention the operator may select one of three constant drilling modes: Constant Thrust Speed, Constant Rotation Pressure (Torque), and Constant Thrust Pressure. In Constant Thrust Speed mode, the autodrill function controls the drill string speed by setting the thrust output signal to a constant value. In Constant Rotation Pressure mode, the autodrilling function controls the thrust pump output based on rotation pressure feedback signals. In Constant Thrust Pressure mode, the autodrill function controls the thrust pump output based on thrust pressure feedback signals. While operating in the Constant Thrust Speed mode the thrust/pullback and rotation pressures are monitored by a derivative control function. As the pressures rise/fall with natural drilling conditions, the actual pressure limit set-points will follow. If either of the pressures change too-fast, then the respective pressure limit set-point is held at the previous 'normal' value to reduce thrust pullback speed—thus controlling the pressure rise. This derivative control function will remain active until the limited pressure returns to the 'normal' value at which it was set.

The present invention allows the thrust output signal (thrust speed) to remain constant unless a particular pressure event occurs. The controller continually, and/or on a periodic time interval, compares the present thrust pressure feedback signal with a previous thrust pressure feedback signal corresponding to an interval of time earlier (e.g., 250 ms). From this comparison a rate of change of thrust pressures is determined. If the calculated derivative is less than an allowable derivative, then the thrust pressure is allowed to increase. For instance, in a pullback operation of the drill string where a constant mixing rate may be desired, the constant speed mode can be selected. However, as the load increases due to trailing product, and/or change in soil condition, then the thrust pressure will automatically rise, without any decreases in the thrust/pullback speed.

If on the other hand the calculated derivative is greater than the allowable derivative, then at 200 ms another thrust pressure feedback reading is taken. If the pressure is greater than the last pressure reading (−200 ms) then the thrust pressure limit (normally at 100%) is set to the thrust pressure limit at −450 ms and the thrust pump output signal is decreased. This in essence de-strokes the thrust pump.

If the calculated derivative is greater than the allowable derivative, as before, then at 200 ms another thrust pressure feedback reading is taken. If this pressure is less than the pressure taken −200 ms earlier, then the thrust pressure limit will remain at 100%.

If the thrust pressure is held because the derivative was larger than allowable, and should the thrust pressure fail to decrease (increase in hard formation), then the operator can use an increment/decrement switch to raise the original thrust pressure to the pressure.

Some embodiments of the invention concern a horizontal directional drilling (HDD) system having one or more automatic drilling modes. The HDD system can include a drill pipe configured to attach to a boring tool, a thrust pump configured to linearly advance the drill pipe, a rotation pump configured to rotate the drill pipe, one or more pressure sensors configured to measure hydraulic fluid pressure, and a controller coupled to the thrust pump and pressure sensor, the controller configured to execute program instructions stored in memory to cause the HDD system to perform drilling operations in a constant parameter mode in which an output parameter is maintained at a constant level, compare the hydraulic fluid pressure measurements to a variable pressure limit while the HDD system is operating in the constant parameter mode, calculate a derivative value of the hydraulic fluid pressure measurements and compare the derivative value to a derivative threshold, decrease the variable pressure limit if the derivative value exceeds the derivative threshold, wherein the amount that the variable pressure limit is decreased is based on one or more of the hydraulic fluid pressure measurements, and reduce output of the thrust pump when the comparison of the hydraulic fluid pressure measurements to the variable pressure limit indicates that one or more of the hydraulic fluid pressure measurements exceed the variable pressure limit.

In some HDD system embodiments of the invention, the controller is further configured to store the hydraulic fluid pressure measurements in the memory and decrease the variable pressure limit to a value that is similar or equal to a hydraulic fluid pressure value that was measured and stored before the derivative value exceeded the derivative threshold thereby triggering the variable pressure limit decrease.

In some HDD system embodiments of the invention, a value to which the variable pressure limit is decreased is equal to a most recent hydraulic fluid pressure measurement of the hydraulic fluid pressure measurements that was measured by the one or more pressure sensors before the derivative value exceeded the derivative threshold thereby triggering the variable pressure limit decrease.

In some HDD system embodiments of the invention, the controller is further configured to increase the variable pressure limit when one or more of the hydraulic fluid pressure measurements are less than the variable pressure limit.

In some HDD system embodiments of the invention, the controller is further configured to initiate a time interval if the derivative value exceeds the derivative threshold, calculate an additional derivative value of the hydraulic fluid pressure measurements based on one or more hydraulic fluid pressure measurements taken after the time interval expires, compare the additional derivative value to the derivative threshold, and decrease the variable pressure limit if the additional derivative value exceeds the derivative threshold.

Some HDD system embodiments of the invention may further comprising a user interface, wherein the controller is further configured to increase the variable pressure limit based on information received from the user interface.

In some HDD system embodiments of the invention, at least one of the one or more pressure sensors is configured to measure hydraulic fluid pressure of the rotation pump and the calculation of the derivative value of the hydraulic fluid pressure measurements is based on hydraulic fluid pressure measurements taken from the rotation pump.

In some HDD system embodiments of the invention, at least one of the one or more pressure sensors is configured to measure hydraulic fluid pressure of the thrust pump and the calculation of the derivative value of the hydraulic fluid pressure measurements is based on hydraulic fluid pressure measurements taken from the thrust pump.

In some HDD system embodiments of the invention, a first pressure sensor of the one or more pressure sensors is configured to measure hydraulic fluid pressure of the rotation pump, a second pressure sensor of the one or more pressure sensors is configured to measure hydraulic fluid pressure of the thrust pump, and the decrease of the variable pressure limit is based on one or more derivative values calculated from hydraulic fluid pressure measurements taken by one or both of first pressure sensor and the second pressure sensor.

In some HDD system embodiments of the invention, the controller is further configured to decrease the variable pressure limit to a value having a proportional relationship relative to one of the hydraulic fluid pressure measurements that was taken by one of the pressure sensors before the derivative value exceeded the derivative threshold thereby triggering the variable pressure limit decrease.

In some HDD system embodiments of the invention, the controller is configured to maintain a constant linear advancement of the drill pipe in the constant parameter mode and the derivative value is calculated from one or both of rotation pump hydraulic fluid pressure and thrust pump hydraulic fluid pressure as sensed by the one or more pressure sensors.

In some HDD system embodiments of the invention, the controller is configured to maintain a constant thrust pressure in the constant parameter mode and the derivative value is calculated from rotation pump hydraulic fluid pressure as sensed by the one or more pressure sensors.

In some HDD system embodiments of the invention, the controller is configured to maintain a constant rotation pressure of the rotation pump in the constant parameter mode and the derivative value is calculated from thrust pump hydraulic fluid pressure as sensed by the one or more pressure sensors.

Some method embodiments of the invention concern HDD in an automatic drilling mode. Such method embodiments can include maintaining a constant output parameter while performing a drilling operation using an HDD rig having a thrust pump, generating hydraulic fluid pressure measurements from one or more pumps of the HDD rig, comparing the hydraulic fluid pressure measurements to a variable pressure limit, calculating a derivative value using the measured hydraulic fluid pressure measurements, comparing the derivative value to a derivative threshold, decreasing the variable pressure limit when the derivative value exceeds the derivative threshold, wherein the amount that the variable pressure limit is decreased is based on one or more of the hydraulic fluid pressure measurements, and reducing output of the thrust pump when the comparison of the hydraulic fluid pressure measurements to the variable pressure limit indicates that one or more of the hydraulic fluid pressure measurements exceed the variable pressure limit.

In some HDD method embodiments of the invention, the hydraulic fluid pressure measurements are stored in memory, wherein a value to which the variable pressure limit is decreased when the derivative value exceeds the derivative threshold is similar or equal to a stored hydraulic fluid pressure measurement that was taken before the comparison of the derivative value to the derivative threshold indicated that the derivative value exceeded the derivative threshold thereby triggering the variable pressure limit decrease.

In some HDD method embodiments of the invention, a value to which the variable pressure limit is decreased is equal to one of the hydraulic fluid pressure measurements that was taken before the comparison of the derivative value to the derivative threshold indicated that the derivative value exceeded the derivative threshold thereby triggering the variable pressure limit decrease.

Some HDD method embodiments of the invention further include increasing the variable pressure limit when one or more of the hydraulic fluid pressure measurements are less than the variable pressure limit.

Some HDD method embodiments of the invention further include initiating a time interval when the derivative value exceeds the derivative threshold, calculating an additional derivative value using the measured hydraulic fluid pressure measurements taken after the time interval expires, comparing the additional derivative value to the derivative threshold, and decreasing the variable pressure limit if the additional derivative exceeds the derivative threshold.

Some HDD method embodiments of the invention further include increasing the variable pressure limit based on user input.

In some HDD method embodiments of the invention, the one or more pumps from which the hydraulic fluid pressure measurements are taken is a rotation pump of the HDD rig.

In some HDD method embodiments of the invention, the one or more pumps from which the hydraulic fluid pressure measurements are taken is the thrust pump of the HDD rig.

In some HDD method embodiments of the invention, the one or more pumps from which the hydraulic fluid pressure measurements are taken is the thrust pump and a rotation pump of the HDD rig and the decrease of the variable pressure limit is based on one or more derivatives values calculated from fluid pressure measurements taken from one or both of the thrust pump and the rotation pump.

In some HDD method embodiments of the invention, decreasing the variable pressure limit further comprises decreasing the variable pressure limit to a value having a proportional relationship to one or more of the hydraulic fluid pressure measurements taken before the comparison of the derivative value to the derivative threshold triggered the variable pressure limit decrease.

In some HDD method embodiments of the invention, maintaining the constant output parameter further comprises adjusting respective outputs of the thrust pump and a rotation pump to maintain a constant linear advancement of a drill pipe and wherein the derivative value is calculated from one or both of hydraulic fluid pressure measurements taken from one or both of the rotation pump and the thrust pump.

In some HDD method embodiments of the invention, maintaining the constant output parameter further comprises adjusting the thrust pump output to maintain a constant thrust pressure and the hydraulic fluid pressure measurements are taken from a rotational pump.

In some HDD method embodiments of the invention, maintaining the constant output parameter further comprises adjusting the thrust pump output to maintain a constant rotation pressure and the hydraulic fluid pressure measurements are taken from the thrust pump.

Some embodiments of the invention concern a HDD system configured to operate in an automatic drilling mode. Such a HDD system may include means for maintaining a constant output parameter while performing a drilling operation using an HDD rig having a thrust pump, means for generating hydraulic fluid pressure measurements from one or more pumps of the HDD rig, means for comparing the hydraulic fluid pressure measurements to a variable pressure limit, means for calculating a derivative value using the measured hydraulic fluid pressure measurements, means for comparing the derivative value to a derivative threshold, means for decreasing the variable pressure limit when the derivative value exceeds the derivative threshold, the amount that the variable pressure limit is decreased based on one or more of the hydraulic fluid pressure measurements, and means for reducing output of the thrust pump when the comparison of the hydraulic fluid pressure measurements to the variable pressure limit indicates that one or more of the hydraulic fluid pressure measurements exceed the variable pressure limit.

In some HDD system embodiments of the invention, a value to which the variable pressure limit is decreased when the derivative value exceeds the derivative threshold is equal to one of the hydraulic fluid pressure measurements that was generated before the comparison of the derivative value to the derivative threshold indicated that the derivative value exceeded the derivative threshold thereby triggering the variable pressure limit decrease.

While the invention will be described with respect to preferred embodiment configurations and with respect to particular devices used therein, it will be understood that the invention is not to be construed as limited in any manner by either such configuration or components described herein.

Also, while the particular types of switches, controllers, operator input devices, hydraulic pumps and motors are described herein, it will be understood that such particular mechanisms are not to be construed in a limiting manner. Instead, the principles of this invention extend to any environment in which automatically maintaining various drilling states are desired. These and other variations of the invention will become apparent to those skilled in the art upon a more detailed.

DESCRIPTION OF THE INVENTION

Brief Description of the Drawings

The accompanying drawings, which are incorporated herein and constitute a part of the specification, illustrate several aspects of the invention and together with the description, serve to explain the principles of the invention. A brief description of the drawings is as follows.

DETAILED DESCRIPTION OF THE PREFERRED EMBODIMENT

The discussion and illustrations provided herein are presented in an exemplary format, wherein selected embodiments are described and illustrated to present the various aspects of the present invention. Systems, devices, or methods according to the present invention may include one or more of the features, structures, methods, or combinations thereof described herein. For example, a device or system may be implemented to include one or more of the advantageous features and/or processes described below. A device or system according to the present invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

This present invention generally relates to underground boring machines, such as HDD machines, and more particularly to a method and apparatus for controlling underground boring tools with an electro-hydraulic control system. The present invention allows the operator to establish and/or change between controlled drilling modes. As noted, some drilling conditions require constant thrust/pullback speed while others may require constant thrust/pullback pressure or constant rotation torque. Operators can select between the desired drilling modes to use the most advantageous mode for the current conditions. The detailed description of the present invention will now be deferred pending a brief overview of an HDD machine and a control system.

HDD Machine

Figure 1:
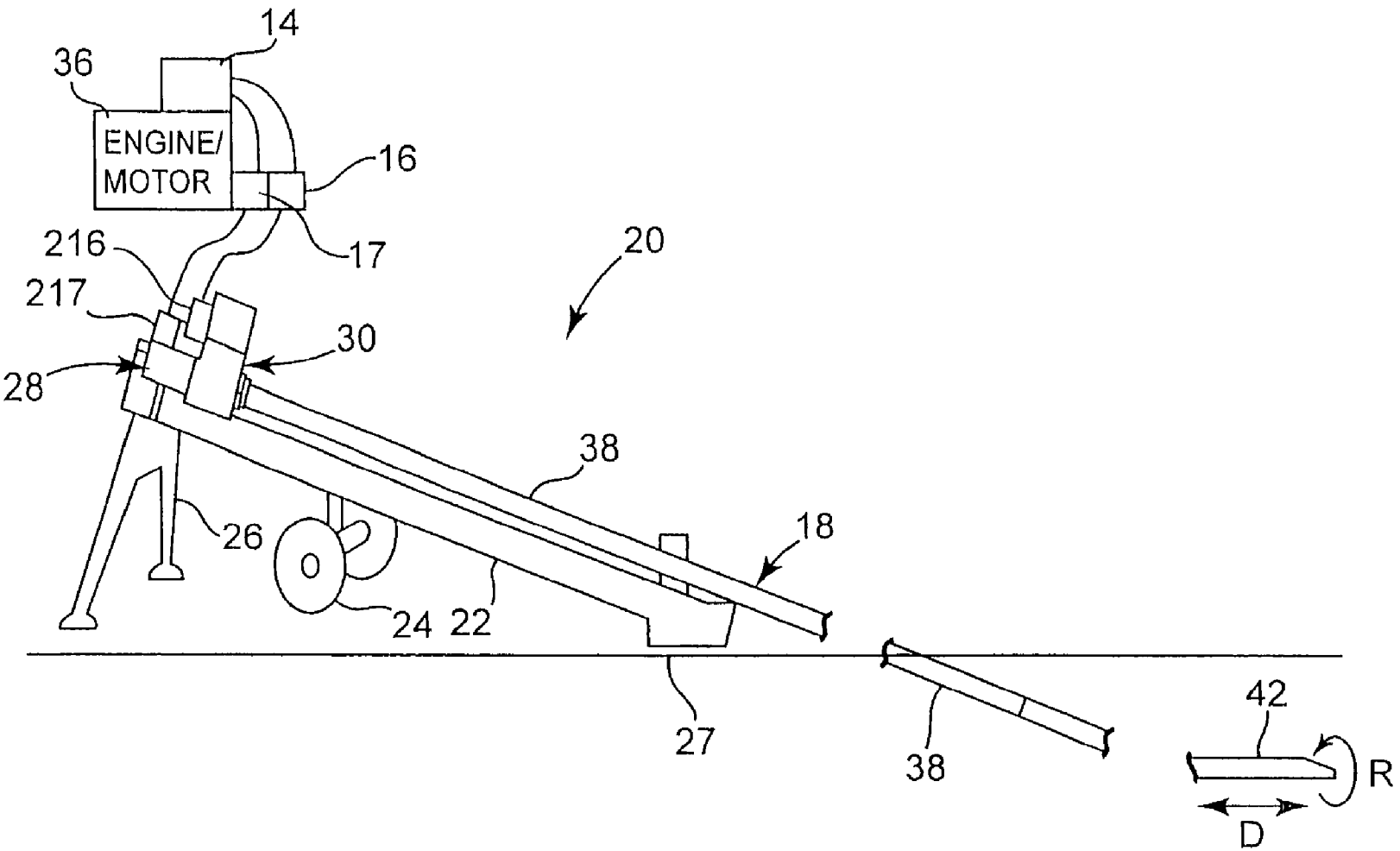
FIG. 1 illustrates a horizontal directional drilling machine.

A horizontal directional drilling machine 20, illustrated in FIG. 1, includes a frame 22 on which is mounted a rotational drive mechanism 30 that is slidably moved along a longitudinal axis of the frame 22. In one embodiment, horizontal directional drilling machine includes a rear stabilizer 26 and front stabilizer 27 for positioning and stabilizing the machine at the drilling site, and a wheel assembly 24 for supporting the machine during transport between job sites. A drill string 18 comprises a boring tool 42 designed to engage the soil and one of more drilling rods 38 that transmit forces from machine to the boring tool 42. The rotational drive mechanism 30 typically includes a gearbox and a drive spindle that rotates the drill string 18 about its longitudinal axis, the rotational power being preferably provided by hydraulic motor 216. The horizontal directional drilling machine 20 also includes a thrust drive mechanism 28 that typically includes gears or sprockets to move the drive mechanism 28 up and down the frame 22 to advance the drill sting 18 into, or withdraw it from, the soil. The thrust power is preferably provided by hydraulic motor 217. In some embodiments, an engine 36 drives hydraulic pumps 16 and 17 which pressurize fluid that is transferred to hydraulic motors 216 and 217.

The hydraulic systems can be either open loop where the fluid is transferred from a hydraulic reservoir 14 through the pumps to the motors 216, 217 and back to the reservoir 14, or they can be hydrostatic where the fluid is substantially in a closed loop—being transferred between the pump and the motor. In either system the pumps 16, 17 and motors 216, 217 are matched, such that by controlling the flow rate of the hydraulic fluid, the speed of rotation of the output shafts of the motors is controlled and can be inferred. The pumps are typically variable displacement pumps capable of producing variable output flow rates. The variable output can be proportionally controlled by an electrical current provided by a control system. The output speed of the pumps is proportional to the output flow rates.

While the speed can be controlled, the pressure of the hydraulic fluid can be monitored to infer the torque being generated by the motor, which is directly proportional to the longitudinal force or rotational torque being generated. Other embodiments are possible, for instance wherein rotational and thrust drive mechanisms could be actuated by different hydraulic drives (e.g. such as hydraulic cylinders).

Some embodiments may also include a water flow mechanism that transmits water through the drill string 18 to the vicinity of the boring tool 42, where the water flow entrains cut soil particles and removes them from the hole. The horizontal directional drilling machine may also include a greater for lubricating various moving components (not shown).

Figure 2:
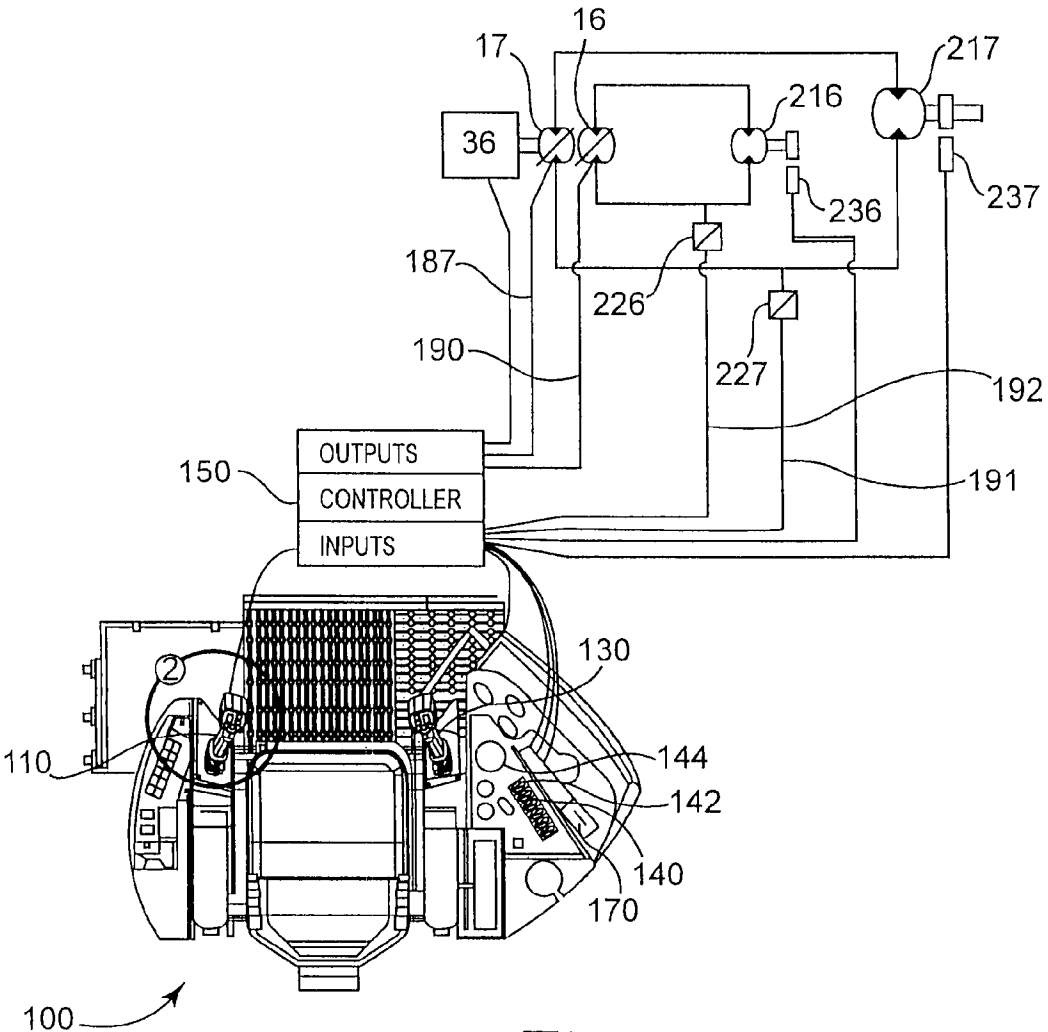
FIG. 2 illustrates the operator control station of a horizontal directional drilling machine according to the principles of the present invention.

FIG. 2 illustrates an exemplary operator control station 100 for a horizontal directional drilling machine 20. Operator control station 100 includes rotational control 110 and thrust control 130 that provide inputs to a controller 150.

Many embodiments of controls 110 and 130 are usable. For example, in one usable embodiment, each of controls 110 and 130 comprise a control lever. In such an embodiment, control levers 110, 130 each produce an electrical signal that is proportional to the position of the control lever relative to a center position. The electrical signal is provided as an input to a controller 150.

In one embodiment, when the control lever 110, 130 is moved away from the center position, the electrical signal that is generated corresponds to increased rotational torque (and/or rate of rotational movement) or axial thrust force (and/or rate of axial movement), respectively. As the control lever 110, 130 is moved closer toward the center position, the generated electrical signal corresponds to decreased rotational torque (and/or rate of rotational movement) or axial thrust force (and/or rate of axial movement), respectively. In one embodiment, when the control lever 110 is moved in the forward direction, away from the operator, the generated electrical signal corresponds to counter-clockwise rotational movement of the drill string, as viewed looking at the end of the drill string. Alternatively, when the control lever 110 is moved in the backwards direction, toward the operator, the electrical signal that is generated corresponds to the opposite direction, clockwise rotational movement. Likewise, in some embodiments, when control lever 130 is moved forward, away from the operator, the electrical signal that is generated corresponds to forward movement of the drill string into the soil. Alternatively, when control lever 130 is moved in the backwards direction, toward the operator, the electrical signal that is generated corresponds to backwards movement of the drill string back toward the machine.

When either of control lever 110, 130 is in the center position, the electrical signal that is generated may correspond to a neutral condition where the rotational or thrust movement respectively is set to zero. A spring or other biasing mechanism may be provided to return each of the control levers to the center position, so that if an operator does not hold the lever, it returns to its centered, neutral position such that the rotational or thrust motion settings are set to zero.

The controller 150 generates outputs, in response to various inputs, to control the hydraulic system. The system includes the hydraulic pumps 16 and 17 of the drilling machine 20. The hydraulic motors 216, 217 are driven by the hydraulic fluid to create rotational and thrust movement of the boring tool 42 and drill string 18. As noted above, this control is typically a variable electrical current, wherein a certain electrical current will cause the pump to create a certain hydraulic flow rate. The output shaft of the motor thereby rotates at a certain speed of rotation. This is typically independent of the pressure in the fluid. The control systems are typically designed to provide speed control that is independent of load. The control systems typically further include pressure transducers 226 and 227 that provide feedback to the control system indicating the pressure in the circuits, and can further include speed sensors 236 and 237 for measuring the output speed of the motors.

Figure 4:
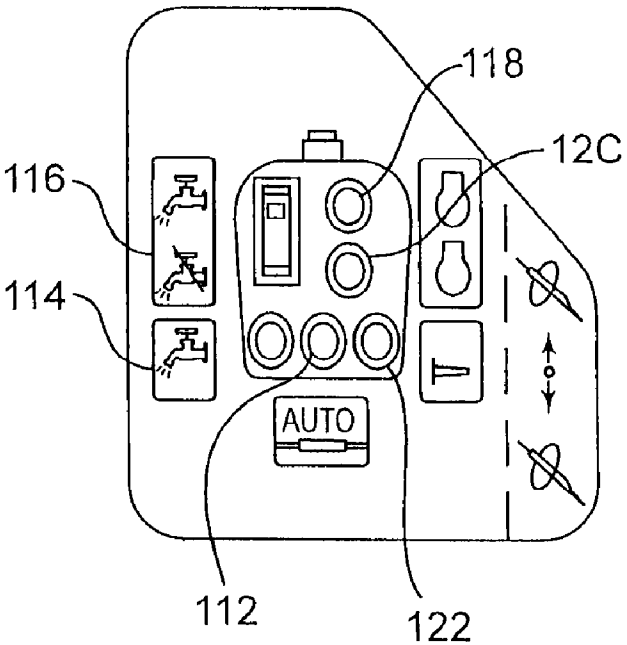
FIG. 4 illustrates a label identifying the function of the controls found on the control lever of FIG. 3.
Figure 3:
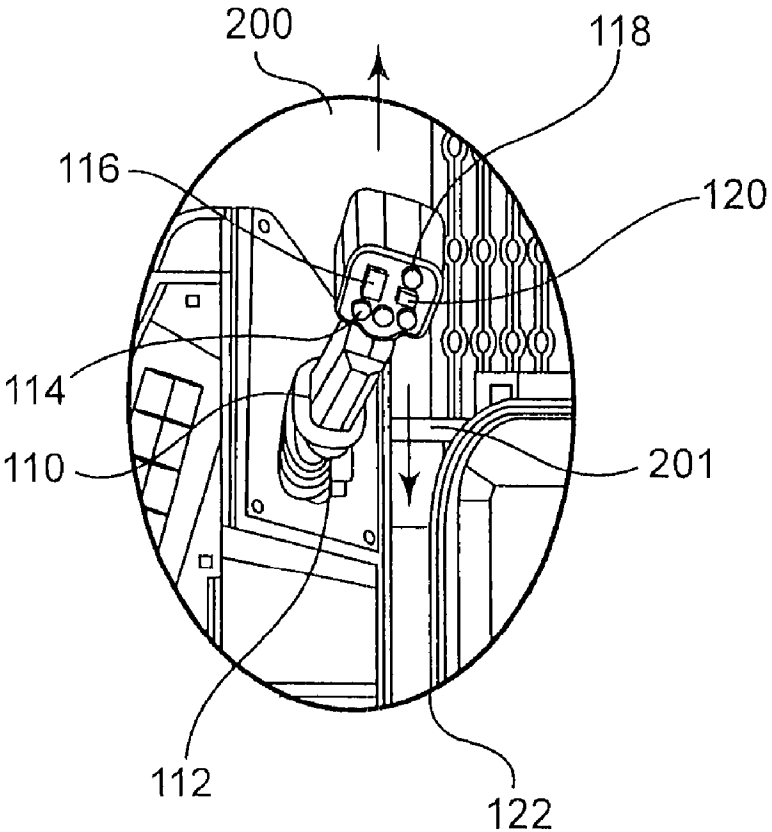
FIG. 3 illustrates a control lever of the operator control station of FIG. 2.

FIG. 3 illustrates the rotational movement control 110 in more detail, showing the various control switches that are mounted on the control. FIG. 4 illustrates a sign that indicates the functions of each of these switches to the operator. Control 110 includes switches 112, 118, 120, and 122, each of which generates an electrical signal when actuated, such as by being pressed. Control switch 112 may be called a SET switch. When SET switch 112 is actuated, an electrical signal is sent to controller 150 activating an automatic boring mode (also called autoboring mode). When controller 150 receives a signal from SET switch 112 (or other source), the rotational movement and/or thrust movement parameters are set within the controller to the values established by the positions of controls 110, 130 at the time that the SET switch 112 is actuated.

The preferred technique includes setting a value for the speed of rotation, while setting a value for the pressure in the axial thrust circuit, as will be explained in more detail later. Thereafter, controller 150 automatically maintains the boring parameters of rotational movement and thrust movement at the set values without further input from the operator. The operator then may release control levers 110, 130 without affecting the boring operation, thereby reducing operator fatigue. It will be appreciated that the auto boring mode may also be turned off by actuating the SET switch 112 when the system is currently activated.

In one embodiment, rotational movement control 110 also includes control switches 114 and 116 which control the water flow functions for injecting water into a bored hole to remove cuttings from the hole. Rotational movement control 110 also includes control switches 118 and 120 to control the speed of the engine 36, and control switch 122 to control a greater (not shown).

Figure 6:
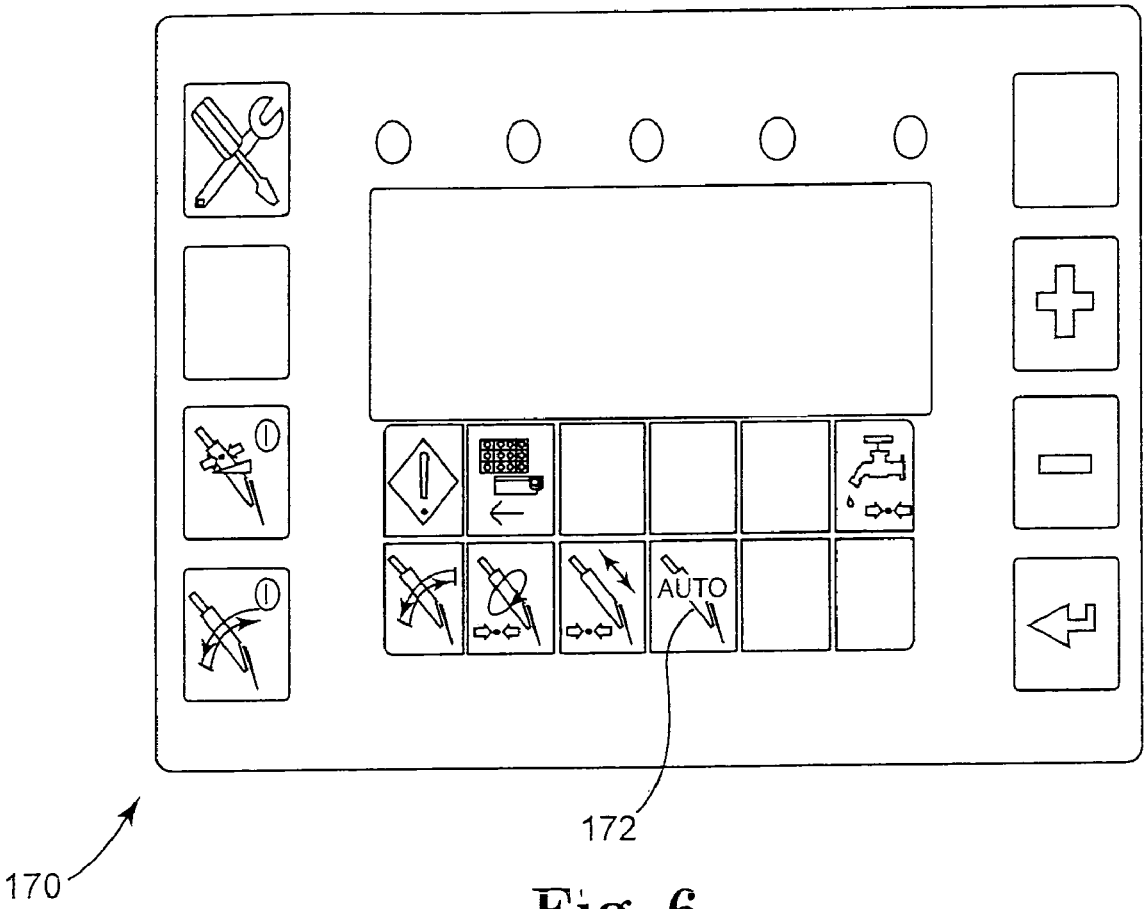
FIG. 6 illustrates a display according to the principles of the present invention.

FIG. 6 illustrates a display 170 for the control system that includes a light 172 that is energized when an auto boring mode is active. This light 172 is energized after the SET switch 112 is activated and a rotation setting and a thrust setting are defined, so as to enter the auto boring mode. Light 172 is deactivated if the auto boring mode is not active.

Figure 5:
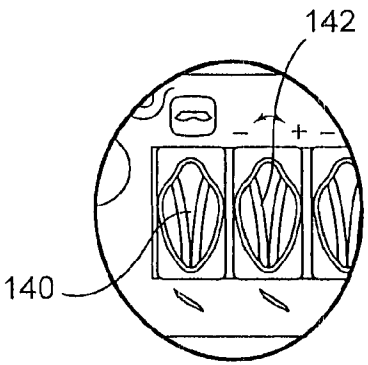
FIG. 5 illustrates controls found on the right side of the operator control station of FIG. 2.

FIG. 5 illustrates additional control switches on the right side of the operator control station 100. In one embodiment, control station 100 includes switches 140, 142 that are in electrical communication with controller 150. Switch 140 has a neutral position, a first operative position, and a second operative position. In one embodiment, switch 140 is spring-loaded to the neutral position, so that when the switch is placed in either the first or second operative positions and then released, switch 140 will return to the neutral position. When switch 140 is in the neutral position, switch 140 has no effect on the boring operation. When switch 140 is placed in the first operative position, such as where switch 140 is rotated clockwise away from the neutral position, and when the auto bore mode is activated, an electrical signal is sent to controller 150 to increase the rotational movement setting by a predefined increment.

Similarly, when switch 140 is placed in the second operative position, such as where switch 140 is rotated counterclockwise away from the neutral position, and when the auto bore mode is activated, an electrical signal is sent to controller 150 to decrease the rotational movement setting by a predefined decrement.

Operation of switch 142 is similar. Switch 142 has a neutral position, a first operative position, and a second operative position. In one embodiment, switch 142 is spring-loaded to the neutral position, so that when the switch is placed in either the first or second operative positions and then released, switch 142 will return to the neutral position. When switch 142 is in the neutral position, switch 142 has no effect on the boring operation. When switch 142 is placed in the first operative position, such as where switch 142 is rotated clockwise away from the neutral position, and when the auto bore mode is activated, an electrical signal is sent to controller 150 to increase the axial thrust pressure setting by a predefined increment. Similarly, when switch 142 is placed in the second operative position, such as where switch 142 is rotated counterclockwise away from the neutral position, and when the auto bore mode is activated, an electrical signal is sent to controller 150 to decrease the axial thrust pressure setting by a predefined decrement.

During the boring or backreaming processes the system then acts to maintain rotation of the drill string at the selected speed of rotation, independent of the rotational pressure setting and axial pressure setting, and will automatically vary the axial thrust speed as necessary to attempt to maintain the selected pressure in the rotation circuit, or to maintain a set amount of force at the boring tool. In consistent formations maintaining a constant force on the drill bit will result in a constant/consistent torque on the drill bit and will maximize drilling efficiency. In formations that vary, this same control technique is also effective.

It may be necessary to interrupt the auto boring mode, such as when it is required to add or remove a drill rod from the drill string. There are several ways in which the auto boring mode may be interrupted. The machine may be configured so that when the auto boring mode is activated, as indicated by light 172, any further motion of controls 110, 130 sends an electrical signal to controller 150 that causes controller 150 to interrupt the auto boring mode. Alternatively, the machine may be configured so that when the auto boring mode is activated, actuating switch 112 sends an electrical signal to controller 150 that causes controller 150 to interrupt the auto boring mode. Alternatively, other switches or controls may be provided or adapted so as to provide an electrical signal to the controller 150 to interrupt the auto boring mode.

One example is a control function related to breaking the connection between the drive chuck or the rotational drive and the drill string. When a drill rod has been inserted, and the rotational drive is at the end of the frame 22, then the rotational drive must be unthreaded from the drill string and moved back to the opposite end of the frame so that another drill rod can be added. This action is required 10 when the rotational drive is located at certain positions along the frame, for instance at the extreme opposite ends. Thus, an interrupt signal can be provided automatically by a sensor that measures the position of the rotational drive. When the interrupt signal is received it may also automatically cancel other functions such as the water flow.

The operator control station 100 also includes switch 144 that is in electrical communication with controller 150. Switch 144 may also be called a RESUME switch. When the auto boring mode has been interrupted, the operator may actuate switch 144 to resume the auto boring mode. Switch 144 then sends an electrical signal to controller 150 that causes controller 150 to resume the auto boring mode at the same settings as existed prior to the auto boring mode being interrupted.

Figure 7:
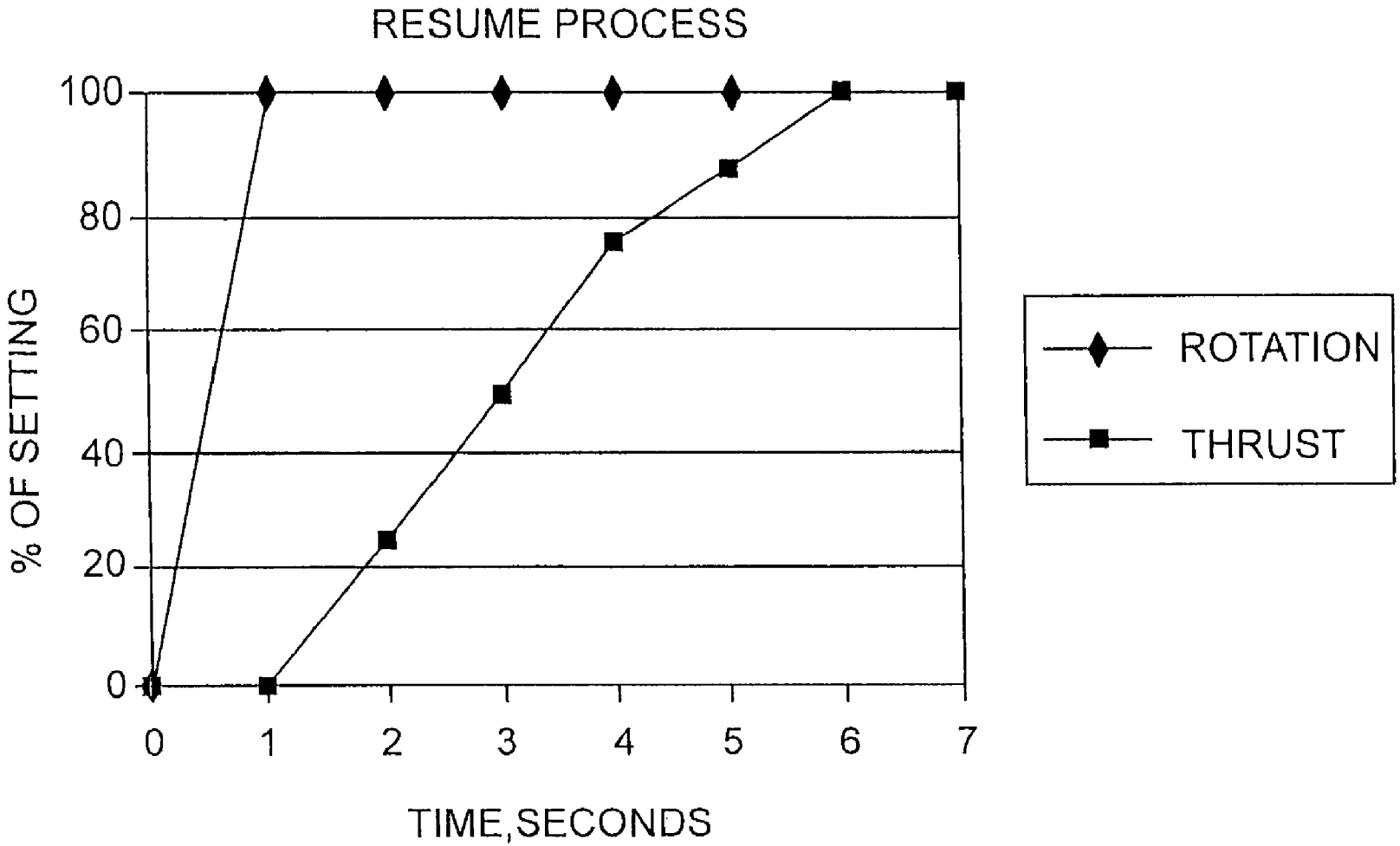
FIG. 7 illustrates the rates of increase of rotational movement and axial thrust when a boring process is resumed.
Figure 8:
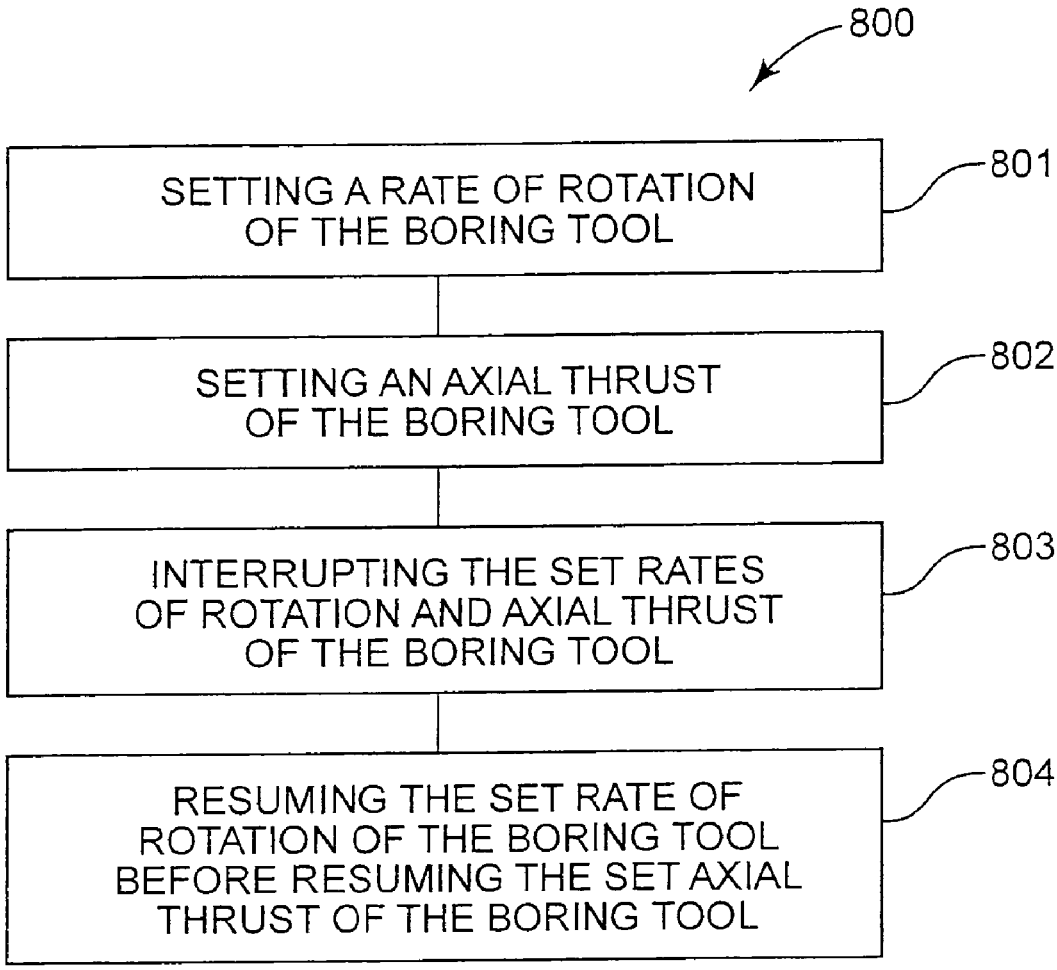
FIG. 8 is a flow diagram of a method of resuming automatic control of boring functions.

Many embodiments of the resume process are usable. The resume process of the present invention initiates drilling operation in a manner that minimizes unnecessary vibration and stress in the drill string and drilling tool. FIGS. 7 and 8 illustrate one usable embodiment of the resume process. The resume process begins (at time equal to 0 seconds) when the switch 144 is depressed to initiate the resume process, sending an electrical signal to the controller 150. The controller 150 will activate the rotational drive mechanism so as to bring the boring tool to the set value of rotational movement, the set rate of rotation. At the same time, not shown on the figures, the water flow is automatically restarted. The resumption of rotational movement occurs rather quickly, usually in about one second. During the time that the rotation is being resumed, controller 150 does not activate the thrust drive mechanism.

In this way, the boring tool will resume rotation to the set rate of rotation while there is little or no longitudinal thrust loading or movement. This operation is advantageous because it produces a smooth rotational acceleration without shock loading of the boring tool and drill string. There are additional benefits to reestablish water flow to the cutting tool prior to new cuttings being generated from axial movement of the drill string.

After the rotational movement setting is attained, approximately one second after the rotation is started, the controller 150 then beings to apply thrust force to the drill string. However, rather than rapidly increasing the thrust force to the set value, the thrust force is increased from zero to the set value, the set axial thrust, at a predetermined rate. In one usable embodiment, the thrust force is applied at a first constant rate of 25% of the set axial thrust force setting for second for three seconds, from the time of one second after the resume process is initiated to the time of four seconds after the resume process is initiated. Thus, having increased by 25% of the thrust force setting for three (3) seconds, the amount of thrust force applied at this point will be 75% of the thrust force setting. The thrust force is then applied at a second constant rate of 12.5% per second for two seconds. Under this resumption example, from the time of four (4) seconds after the resume process is initiated to the time of six (6) seconds after the resume process is initiated, the thrust force is increased from 75% of the set value to 100% of the set value. Thus, at six (6) seconds after the resume process is initiated, the boring tool will be operating both at the set rate of rotation and the set axial thrust An alternative embodiment includes increasing the axial thrust force at a single predetermined rate, such as 25% of the set axial thrust force per second for four (4) seconds. It will be appreciated that other rates may also be used, and that the rates provided herein are presented as preferred embodiments, and not as limitations.

Aspects of HDD are further disclosed in U.S. Pat. No. 6,766,253, U.S. Pat. No. 6,367,564, U.S. Pat. No. 6,389,360, U.S. Pat. No. 5,556,253, U.S. Pat. No. 6,554,082, and U.S. Provisional Application No. 60/927,746 filed May 3, 2007, which are incorporated herein by reference in their respective entireties.

Preferred Embodiment of Constant Modes

As noted above, there are three different modes which are preferably provided in the present invention. The three modes are constant speed mode, constant torque mode and constant thrust mode. It will be appreciated, however, that individual modes or combinations thereof may be employed in drilling equipment. The three modes are next described.

Constant Speed Mode:

When autodrill is SET the thrust/pullback output % is recorded. The autodrill control will maintain this thrust/pullback output % as long as the thrust and rotation pressures do not exceed allowable derivative limits. This allows the operator to maintain a constant thrust pullback speed regardless of nominal pressure variations.

Derivative as used herein is the change in pressure over time, such as hydraulic pressure of a pump. As the pressure changes it is continuously monitored and a derivative calculation is determined at time intervals. If the calculated derivative is less than the set limit (DP1) then there is no resulting change to the thrust/pullback output. This means the pressure can rise or fall as long as the rate-of-change of pressure is not above the set limit. If the pressure rises too fast then the derivative control is triggered. It will then wait for a specified time (DT1) before acting on this pressure rise. If the pressure drops back down before this time is reached there will be no change to the thrust/pullback output. However, if the pressure remains above the derivative trigger value, then the respective pressure set-point will be set to the previous pressure (e.g., the pressure before the derivative control was triggered). This will cause the thrust/pullback output % to decrease until the actual pressure drops back down to the new set-point.

There are multiple ways in which a derivative can be calculated according to the present invention. For example, two pressure readings can be taken at different times. The difference between the two pressure readings is divided by the amount of time between which the readings were taken. A derivative can be expressed numerically to facilitate the comparison to a threshold. For example, a predetermined derivative threshold maybe 20 PSI/second, and a calculated derivative exceeding this threshold could be 25 PSI/second. In a preferred embodiment, the derivative pressure limit is between 100 and 900 PSI/second.

Constant Torque Mode:

When autodrill is SET the rotation pressure and thrust/pullback output % are recorded. The thrust pullback output % will not exceed its recorded output %. If the actual rotation pressure exceeds the recorded value the thrust/pullback output will be reduced to maintain constant torque. This allows the operator to maintain a constant rotational torque at the boring tool 42.

Constant Thrust Mode:

When autodrill is SET the thrust/pullback pressure and output % are recorded. The thrust/pullback output % will not exceed its recorded output %. If the actual thrust/pullback pressure exceeds the recorded value the thrust/pullback output will be reduced to maintain constant force. This allows the operator to maintain a constant thrust/pullback pressure at the boring tool 42.

Figure 9A:
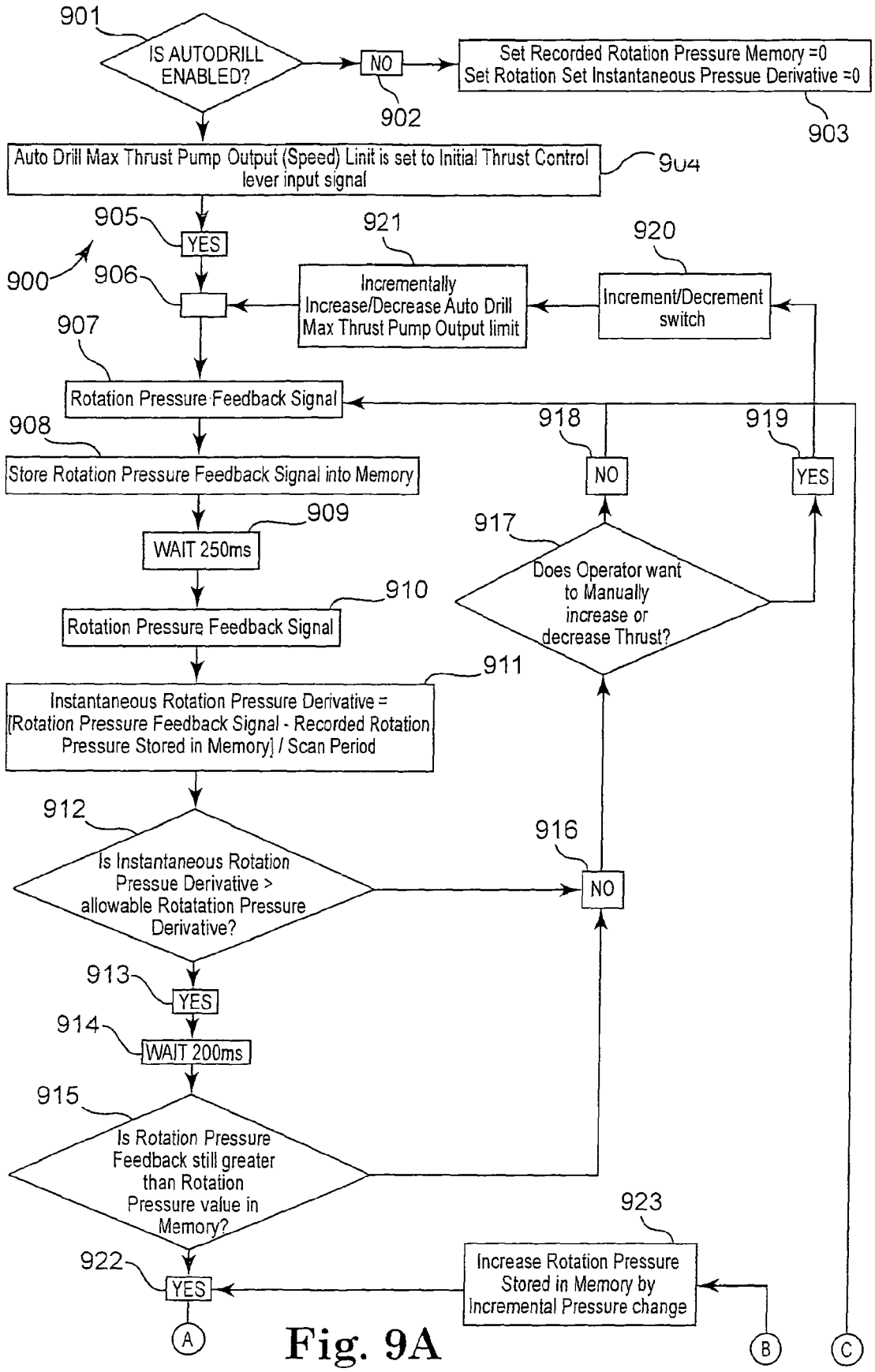
FIG. 9*a* and FIG. 9*b* is a logical flow diagram of an embodiment that implements a constant speed derivative control rotation pressure.
Figure 9B:
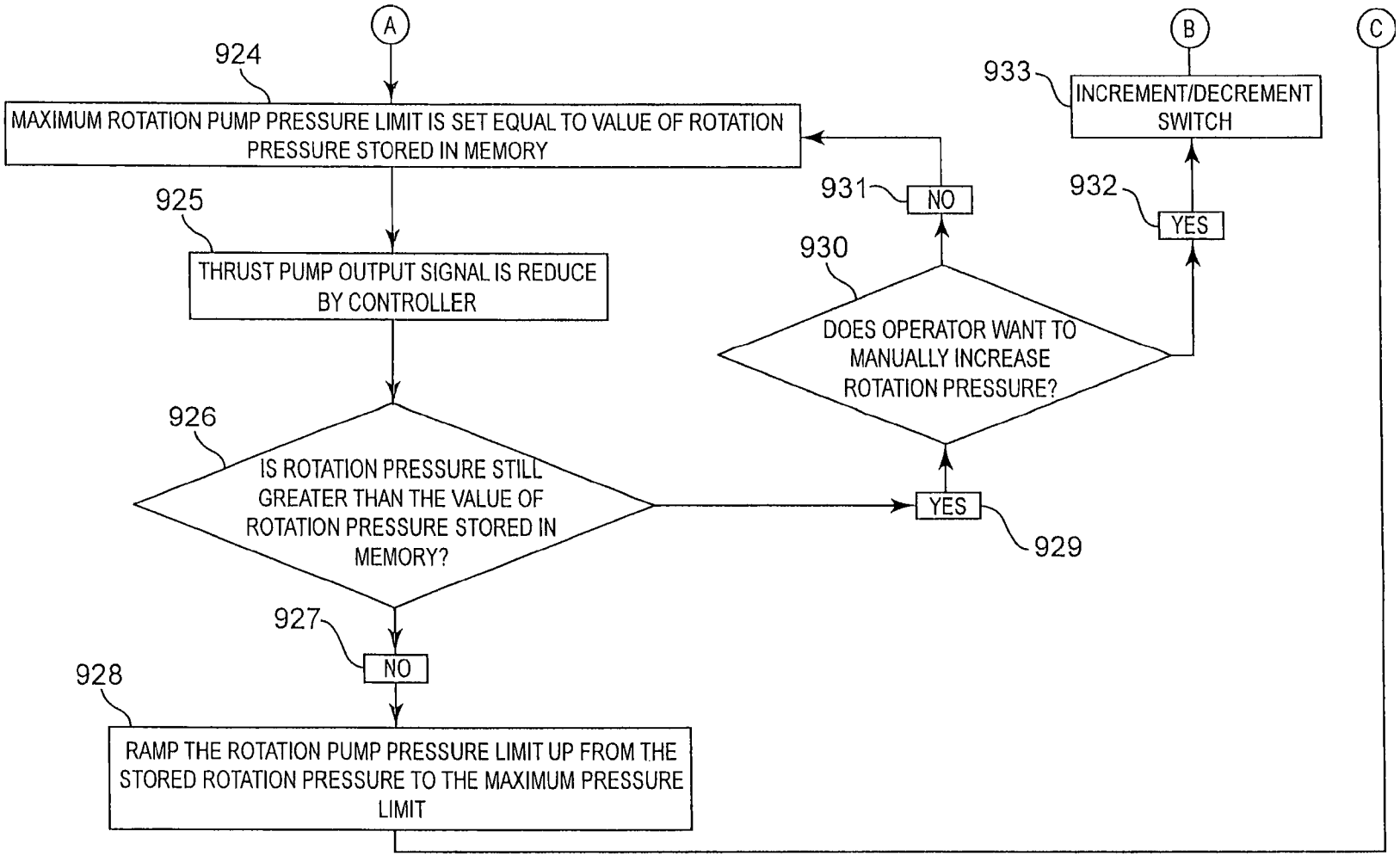

Turning now to FIGS. 9*a* and 9*b*, the logical flow which may be utilized to implement a constant speed derivative control of rotation pressure is illustrated generally at 900. The logical flow may be implemented as programming steps in controller 150, a CPU, other on-board controller or a special programmed smart device.

The process begins at block 901 where it is determined whether autodrill is enabled. If it has not been enabled, the process proceeds to block 902 and 903 where the recorded rotation pressure memory is set to 0 and the rotation instantaneous pressure derivative is also set to 0. The process then returns to block 901 where it is determined whether autodrill is enabled. This loop continues until autodrill mode is selected.

After autodrill has been enabled at block 901, the process proceeds to block 904. Here, the autodrill maximum thrust pump output (speed) limit is set to the initial thrust control lever input signal (for example joystick 130). The process then proceeds through blocks 905 and 906 to block 907 where the rotation pressure feedback signal is received. At block 908, the rotation pressure feedback signal is stored in memory. The process then waits 250 milliseconds at block 909 and the rotation pressure feedback signal is again reviewed at block 910 and at block 911 the instantaneous rotation pressure derivative is calculated. At block 912 the process determines whether the calculated derivative exceeds a predetermined allowable rotation pressure derivative. If no, the process proceeds to block 916 and continuing on to block 917 the process determines whether the operator desires to manually increase or decrease the thrust. If no, the process proceeds to block 918 which then returns back to block 907. If the answer is yes, the process continues to block 919 and then proceeds to block 920 to read the increments/decrements switch. At block 921 the autodrill maximum thrust pump output limit is incremented or decremented accordingly. The process then returns to block 906.

If the instantaneous rotation pressure derivative is greater than the allowable derivative, then the process proceeds to block 913 and continues to block 914 where an additional 200 milliseconds waiting time is maintained. At block 915, the rotation pressure feedback signals are again read and it is determined whether the rotation pressure feedback is still greater than the rotation pressure value in memory. If the answer is no, then the process proceeds to block 916 as described above. If the answer is yes, then the process proceeds to block 924 where the maximum rotation pump pressure limit is set equal to the value of the rotation pressure stored in memory.

Proceeding to block 925 the thrust output signal is reduced by the controller 150. Proceeding to block 926, if the rotation pressure is still greater than the value of the rotation pressure stored in memory, then the process proceeds to block 929 where it is determined whether the operator wishes to manually increase rotation pressure at block 930. If the answer is no, at block 931, the maximum rotation pressure is set equal to the value of the rotation pressure stored in memory at block 924. If the answer is yes, then the increment decrement switch is read at block 933 and the processor proceeds to block 923 and block 922. If the answer is no at block 926, then the process proceeds to block 927 and continues to block 928 where the rotation pump pressure limit is ramped up from the stored rotation pressure to the maximum pressure limit. The process then proceeds back to block 907 to read the next rotation pressure feedback signal.

Figure 10:
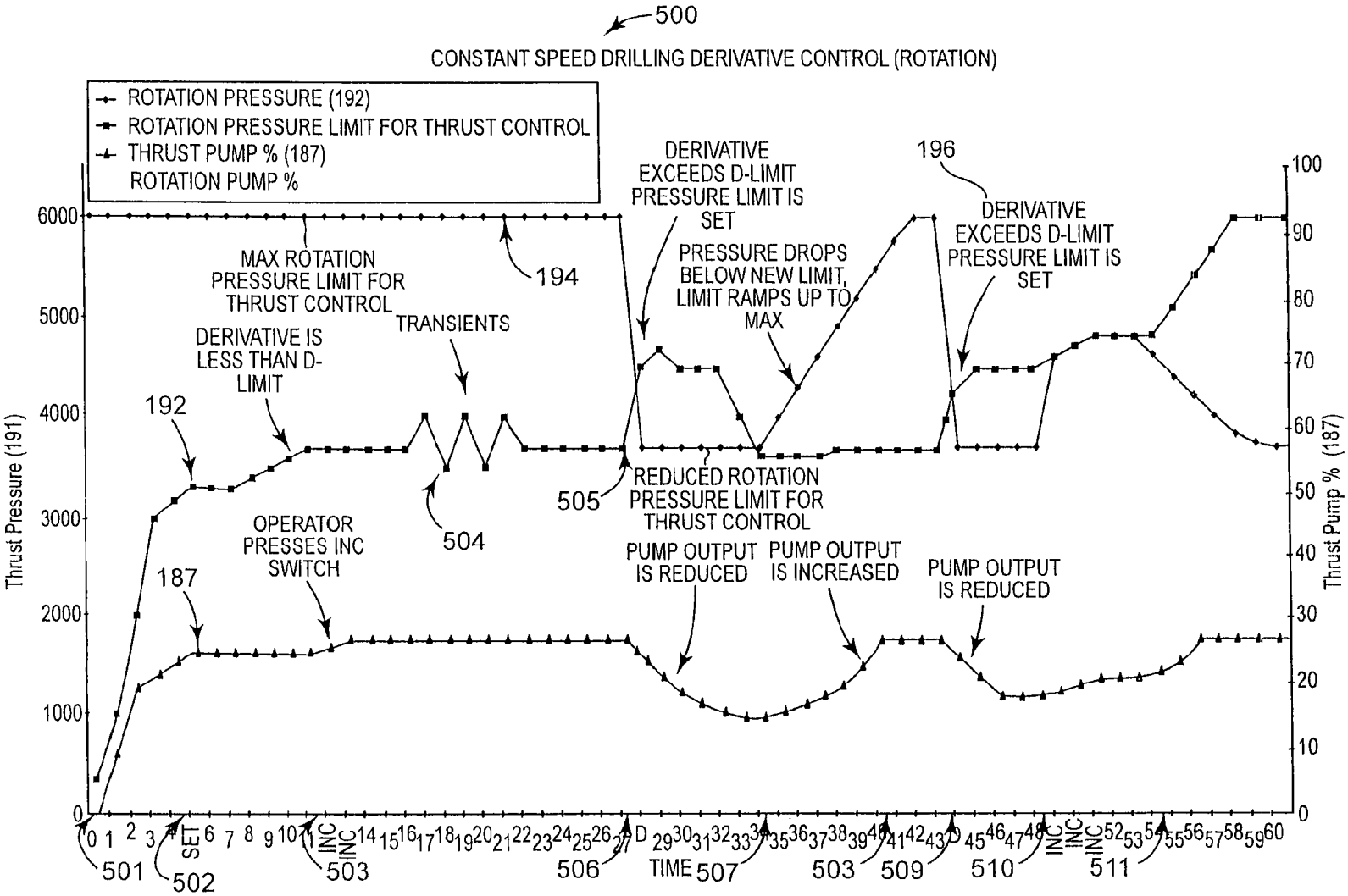
FIG. 10 is a graph illustrating an example of the operation of the rotation pressure, rotation pressure limit for thrust control, thrust pump % and rotation pump % while in constant speed derivative control rotation pressure mode.

FIG. 10 illustrates an example of this Constant Speed mode, including the input provided by the operator where the input is indicated by the designation 187 and the rotation pressure is indicated by the designation 192. Also illustrated in FIG. 10 are the rotation pressure limit 194 and the rotation pump percent 196. Curve 187 corresponds to thrust pump output and therefore is an indication of user input as well as controller commands to the thrust pump to increase/decrease output.

Around 501 a rotation pressure limit 194 is set and thrust pump output 187 and rotation pressure 192 are increased, corresponding to the commencing of drilling operations. Around 502 an operator toggles a SET switch, which causes the drilling system to enter into an autodrill mode having constant speed. It will be understood that the aspects of the invention discussed in connection with FIG. 10 could be included in embodiments of the inventions employing other autodrilling modes, as discussed herein.

Around 502 when the operator presses the SET switch, the thrust pump output 187 is recorded. Thereafter, a controller will maintain this recorded thrust pump output 187, which can correspond to an output capacity percentage, for example. However, the controller may adjust the thrust pump output 187 if certain conditions are met, such as thrust and/or rotation pressures exceeding variable pressure limits, the variable pressure limits subject to derivative variations and user override.

Around 503, the operator increases the thrust pump output 187 from the previous recorded level associated with the pressing of the SET switch around 502. This allows the user the ability to use autodrill functions as discussed herein, but to also increase pump output to optimize drilling operations.

Around 504, changes can be seen in rotation pump pressure 192. While changes in rotation pump pressure 192 can trigger a change in the rotation pressure 194 based on derivatives of rotation pump pressure 192, such changes are not made around 504. There could be several reasons for this. For example, the derivatives of the respective changes in rotation pump pressure 192 may not exceed a derivative threshold. Also, even if one change in pump pressure 192 does exceed the derivative threshold that initiates a time interval, there many not be a corresponding additional derivative also exceeding the derivative threshold during and/or after the time interval that would be necessary in some embodiments to trigger a decrease in the rotation pressure limit 194. As such, having a sufficiently high derivative threshold and additionally or alternatively requiring multiple pressure derivatives exceeding a derivative threshold either within or on opposite sides of a time interval can allow transient and/or small changes in rotation pressure to not effect autodrilling control. In a preferred embodiment, the time interval is between 50 and 500 milliseconds.

Around 506, the rotation pressure 192 increases rapidly. A calculated derivative of the rotation pressure 192 exceeds the pressure derivative, and therefore causes a change in the rotation pressure limit 194.

There are various adjustments that can be made to the rotation pressure limit 194 based on a derivative threshold being exceeded. For example, the maximum rotation pressure limit 194 may be decreased a set amount measured in PSI, a set percentage, or set to a previously recorded value, among other options. The maximum rotation pressure limit 194 is reset to the rotation pressure 192 value 505 recorded before the pressure derivative exceeded the derivative limit. Changing the maximum rotation pressure limit 194 to the previously recorded rotation pressure 192 allows the drilling rig to continue to operate under the same parameters, such that the drill rig could continue to do what it had been doing. If the rotation pressure 192 does not rise thereafter, then the boring operation can continue to make uninterrupted progress. However, if the rotation pressure 192 continues to rise, then the thrust pump output 187 will be reduced, as illustrated, to prevent operating conditions stressful to the drill dig. In this way, the present invention can automatically manage boring productivity and stressful operating condition concerns.

Around 507 the rotation pressure 192 drops below the adjusted rotation pressure limit 194. According to the embodiment of FIG. 10, this causes the controller to increase the rotation pressure limit 194. As illustrated, the rotation pressure limit 194 is increased for each period of time that the rotation pressure 192 remains below the rotation pressure limit 194. The amount of increase for each period can be based on a percentage of the rotation pressure limit 194, a predetermined increment amount, or the rotation pressure 192, among other things.

Also around 507, because rotation pressure 192 has dropped below the adjusted rotation pressure limit 194, the controller increases the thrust pump output 187. In the embodiment illustrated in FIG. 10, the controller increases the thrust pump output 187 incrementally over multiple time periods until the thrust pump output 187 reaches the recorded output level at which the thrust pump output 187 was set at around 502. The amount of increase for each period can be based on a percentage of the thrust pump output 187 or a predetermined increment amount, among other things. Incrementally increasing the thrust pump output 187 allows the system to ease back into the recorded settings without dramatic changes in output which themselves can cause the various measured pressures to rise quickly and exceed the thresholds discussed herein and can avoid stressing boring equipment. Incremental return to preset operation levels also allows the rotation pressure limit 194 to increment over a period of time. However, in some embodiments, the thrust pump output 187 can be immediately reset to the recorded output level once the rotation pressure 192 drops below the rotation pressure limit 194.

Around 508, the pump output 187 has incrementally returned to the recorded output level. Around 509, the derivative of the rotation pressure 192 has exceeded the derivative threshold, causing a decrease in the rotation pressure limit 194, which the rotation pressure 192 exceeds. The rotation pressure 192 exceeding the pressure limit 194 triggers the thrust pump output 187 to be decreased by the controller. In this particular example, the operator may increase the thrust pump output 187 by manually changing the rotation pressure limit 194 if greater output is desired, as shown around 510. Several options are possible for user adjustment of the rotation pressure limit 194. For example, a user could enter in a value to which the rotation pressure limit 194 can be reset. In another option, the rotation pressure limit 194 may be increased an incremental amount or percentage for each time a user presses a button or otherwise indicates a desire to increase the rotation pressure limit 194. According to another option, the rotation pressure limit 194 may be changed to the value of the rotation pressure 192 at the time the user presses a button or otherwise indicates a desire to increase the rotation pressure limit 194.

As the user is adjusting the rotation pressure limit 194 the thrust pump output 187 is increased, because during this time the rotation pressure 182 is not below the rotation pressure limit 194. At around 511 the rotation pressure 192 has fallen below the user adjusted rotation pressure limit 194, causing the rotation pressure limit 194 to be further incremented by the controller.

Although aspects of the present invention have been discussed in FIG. 10 in connection with a Constant Speed mode, these aspects could be application in the other modes discussed herein (e.g., Constant Torque, Constant Thrust). For example, the rotation pressure limit 194 could instead/also be a thrust pressure limit, a mud pump limit, or a limit associated with the other metric discussed herein. Likewise, the thrust pump output could instead/also be a mud pump output, pull-back output, engine output, rotation pump output, and/or another output discussed herein.

Figure 11A:
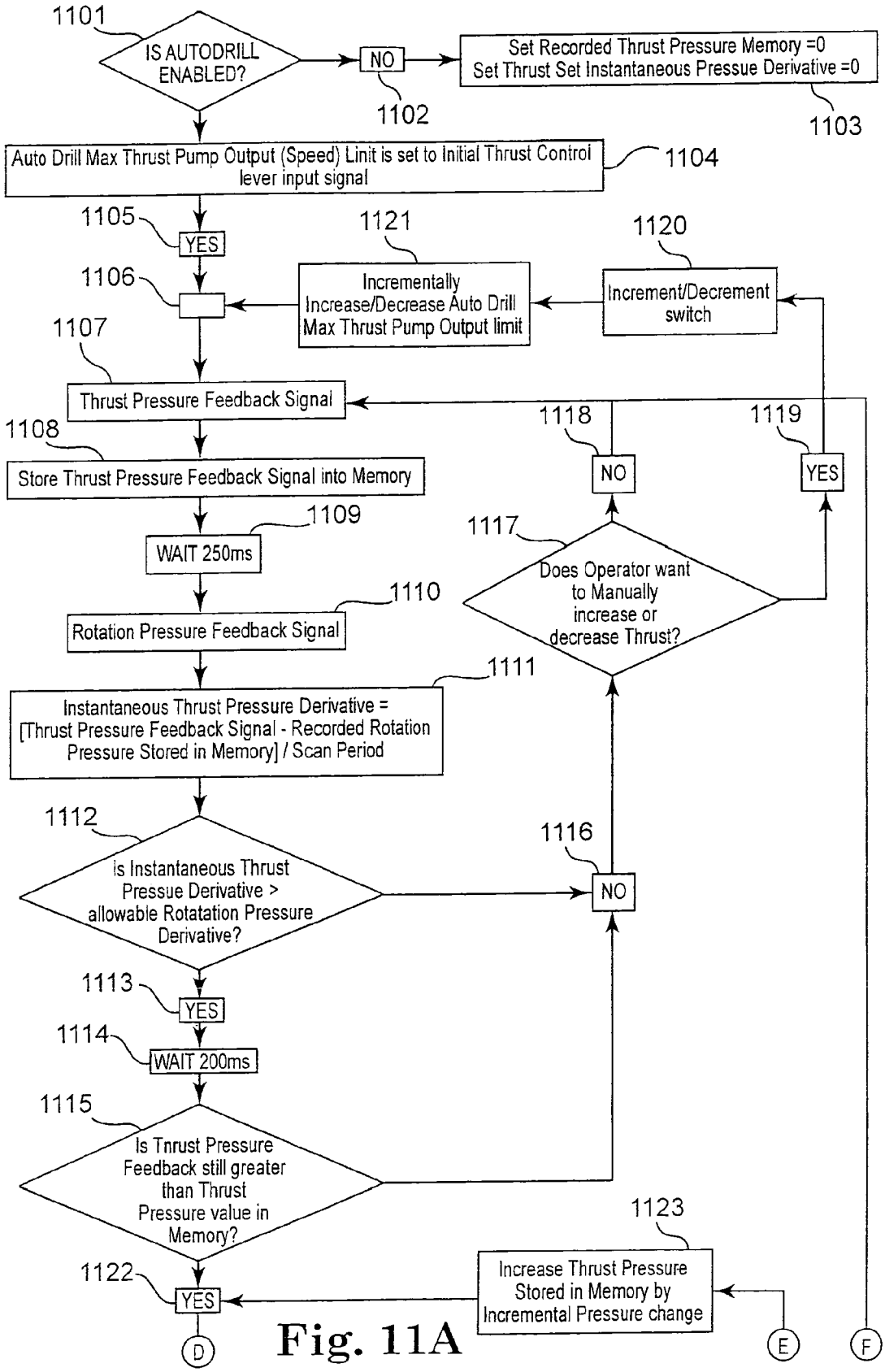
FIG. 11*a* and FIG. 11*b* is a logical flow diagram of an embodiment that implements a constant speed thrust pressure mode.
Figure 11B:
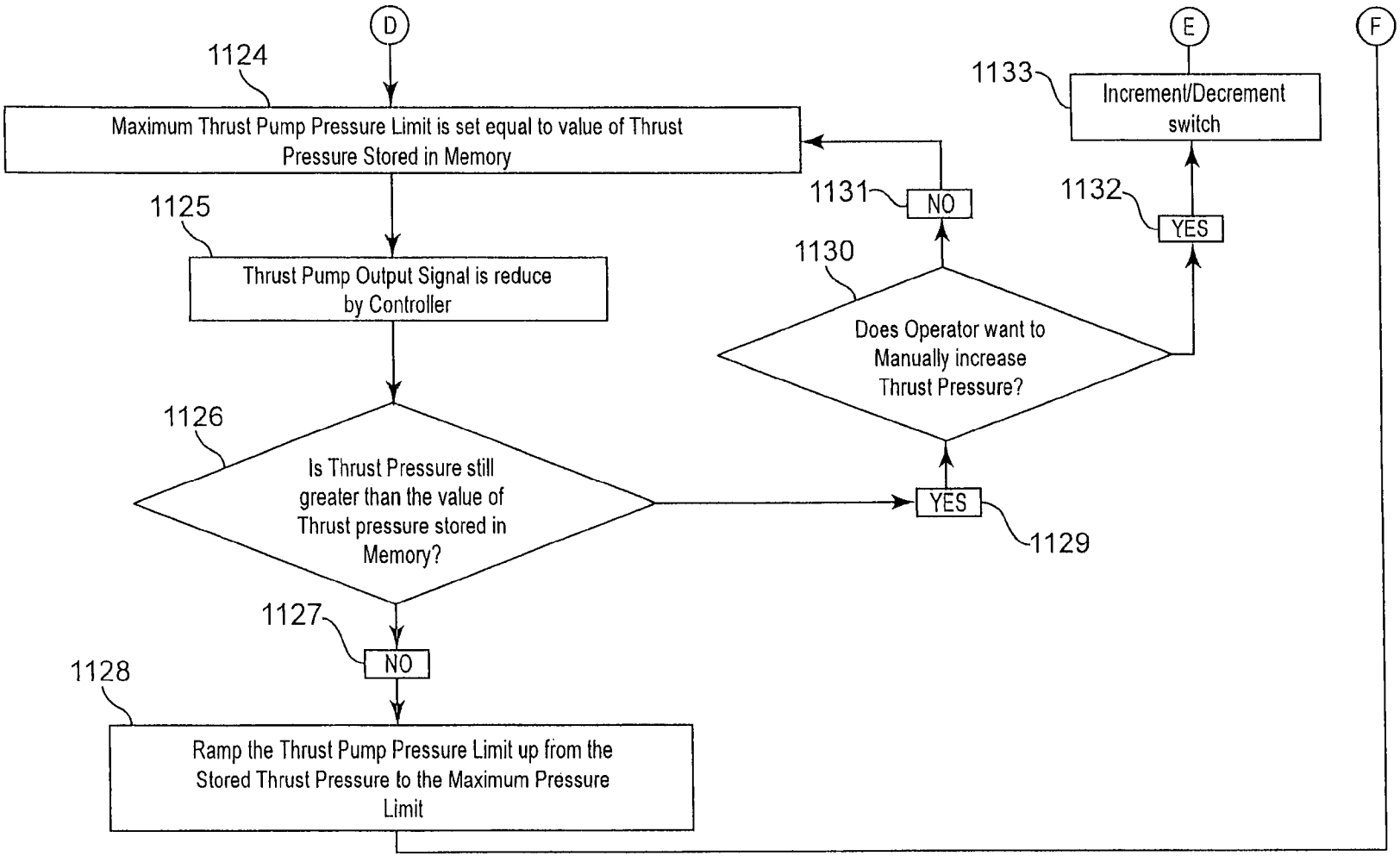

Turning now to FIGS. 11*a* and 11*b*, a logical flow diagram of the steps which may be performed to implement a constant speed mode is illustrated. The constant speed mode logic flow is designated generally at 1100. The process begins at block 1101 where it is determined whether autodrill is enabled. If it has not been enabled, the process proceeds to block 1102*s* and 1103 where the recorded rotation pressure memory is set to and the thrust set instantaneous pressure derivative is also set to 0. The process then again returns to block 1101 where it is determined whether autodrill is enabled.

If autodrill has been enabled at block 1101, the process proceeds to block 1104. Here, the autodrill maximum thrust pump output (speed) limit is set to the initial thrust control lever input signal. The process then proceeds through blocks 1105 and 1106 to block 1107 where the thrust pressure feedback signal is received. At block 1108, the thrust pressure feedback signal is stored in memory. The process then waits 250 milliseconds at block 1109 and the thrust pressure feedback signal is again reviewed at block 1110. Here, then at block 1111, the instantaneous thrust pressure derivative is calculated. At block 1112, the calculated derivative is compared to an allowable thrust pressure derivative to determine if it exceeds the allowable thrust pressure derivative. If no, the process proceeds to block 1116 and it is determined at block 1117 whether the operator desires to manually increase or decrease the thrust. If no, the process proceeds to block 1118 which then returns back to block 1107. If the answer is yes, the process proceeds to block 1119 and then continues to block 1120 to read the increment/decrement switch and then to block 1121 where the autodrill maximum thrust pump output limit is incremented or decremented accordingly. This process then returns to block 1106.

If the instantaneous thrust pressure derivative is greater than allowable derivative, then the process proceeds to block 1113 and to block 1114 where an additional 200 milliseconds waiting time is maintained. At block 1113, the thrust pressure feedback signals are again read and it is determined whether the rotation pressure feedback is still greater than the thrust pressure value in memory. If the answer is no, then the process proceeds to block 1116 as described above. If the answer is yes, then the process proceeds to block 1124 where the maximum thrust pump pressure limit is set equal to the value of the thrust pressure stored in memory, and then to block 1125 where the thrust output signal is reduced by the controller. Proceeding to block 1126, if the thrust pressure is still greater than the value of the thrust pressure stored in memory, then the process proceeds to block 1129 where it is determined whether the operator wishes to manually increase thrust pressure at block 1130. If the answer is no, at block 1131, the maximum thrust pressure is set equal to the value of the thrust pressure stored in memory at block 1124. If the answer is yes, then the increment decrement switch is read at block 1133 and then proceeds to block 1123 and block 1122. If the answer is no at block 1126, then the process proceeds to block 1127 and block 1128 where the thrust pump pressure limit is ramped up from the stored thrust pressure to the maximum pressure limit. The process then proceeds back to block 1107 to read the next thrust pressure feedback signal.

Figure 12:
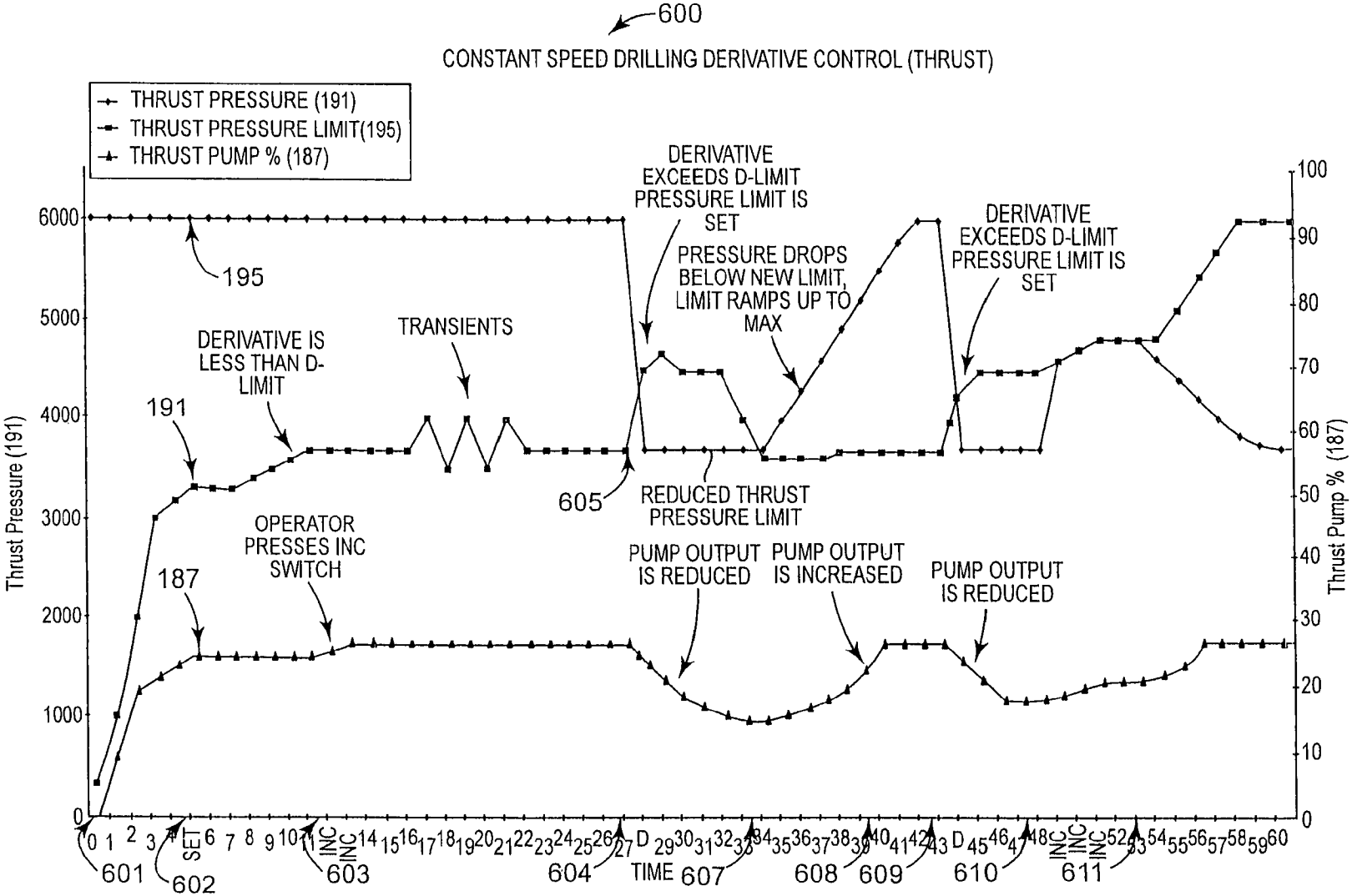
FIG. 12 is a graph illustrating an example in constant speed pressure mode.

FIG. 12 illustrates an example of the previous mode, including the input provided by the operator (indicated at designation 187) and the thrust pressure (indicated at designation 191). Also illustrated are the thrust pressure limit 195 and the thrust pump percent 187.

Curve 187 in FIG. 12 corresponds to thrust pump output and therefore is an indication of user input as well as controller commands to the thrust pump to increase/decrease output.

Around 601 a thrust pressure limit 195 is set and thrust pump output 187 and thrust pressure 191 are increased, corresponding to the commencing of drilling operations. Around 602 an operator toggles a SET switch, which causes the drilling system to enter into an autodrill mode having constant speed. It will be understood that the aspects of the invention discussed in connection with FIG. 12 could be included in embodiments of the inventions employing other autodrilling modes, as discussed herein.

Around 602 when the operator presses the SET switch, the thrust pump output 187 is recorded. Thereafter, a controller will maintain this recorded thrust pump output 187, which can correspond to an output capacity percentage, for example. However, the controller may adjust the thrust pump output 187 if certain conditions are met, such as thrust and/or thrust pressures exceeding variable pressure limits, the variable pressure limits subject to derivative variations and user override, or based on user input.

Around 603, the operator increases the thrust pump output 187 from the previous recorded level associated with the pressing of the SET switch around 602. This allows the user the ability to use autodrill functions as discussed herein, but to also increase pump output to optimize drilling operations.

Around 606, the thrust pressure 191 increases rapidly. A calculated derivative of the thrust pressure 191 exceeds the pressure derivative, and therefore causes a change in the thrust pressure limit 195.

There are various adjustments that can be made to the thrust pressure limit 195 based on a derivative threshold being exceeded. For example, the maximum thrust pressure limit 195 may be decreased a set amount measured in PSI, a set percentage, or set to a previously recorded value, among other options. The maximum thrust pressure limit 195 is reset to the thrust pressure 191 value 605 recorded before the pressure derivative exceeded the derivative limit. Changing the maximum thrust pressure limit 195 to the previously recorded thrust pressure 191 allows the drilling rig to continue to operate under the same parameters, such that the drill rig could continue to do what it has been doing. If the thrust pressure 191 does not rise thereafter, then the boring operation can continue to make uninterrupted progress. However, if the thrust pressure 191 continues to rise, then the thrust pump output 187 will be reduced, as illustrated, to prevent operating conditions stressful to the drill dig. In this way, the present invention can automatically manage boring productivity and stressful operating condition concerns.

Around 607 the thrust pressure 191 drops below the adjusted thrust pressure limit 195. According to the embodiment of FIG. 12, this causes the controller to increase the thrust pressure limit 195. As illustrated, the thrust pressure limit 195 is increased for each period of time that the thrust pressure 191 remains below the thrust pressure limit 195. The amount of increase for each period can be based on a percentage of the thrust pressure limit 195, a predetermined increment amount, or the thrust pressure 191, among other things.

Also around 607, because thrust pressure 191 has dropped below the adjusted thrust pressure limit 195, the controller increases the thrust pump output 187. In the embodiment illustrated in FIG. 12, the controller increases the thrust pump output 187 incrementally over multiple time periods until the thrust pump output 187 reaches the recorded output level at which the thrust pump output 187 was set at around 602. The amount of increase for each period can be based on a percentage of the thrust pump output 187 or a predetermined increment amount, among other things.

Around 608, the pump output 187 has incrementally returned to the recorded output level. Around 609, the derivative of the thrust pressure 191 has exceeded the derivative threshold, causing a decrease in the thrust pressure limit 195, which the thrust pressure 191 exceeds. The thrust pressure 191 exceeding the pressure limit 195 triggers the thrust pump output 187 to be decreased by the controller. In this particular example, the operator may increase the thrust pump output 187 by manually changing the thrust pressure limit 195 if greater output is desired, as shown around 610. Several options are possible for user adjustment of the thrust pressure limit 195. For example, a user could enter in a value to which the thrust pressure limit 195 can be reset. In another option, the thrust pressure limit 195 may be increased an incremental amount or percentage for each time a user presses a button or otherwise indicates a desire to increase the thrust pressure limit 195. According to another option, the thrust pressure limit 195 may be changed to the value of the thrust pressure 191 at the time the user presses a button or otherwise indicates a desire to increase the thrust pressure limit 195.

As the user is adjusting the thrust pressure limit 195 the thrust pump output 187 is increased, because during this time the thrust pressure 182 is not below the thrust pressure limit 195. At around 611 the thrust pressure 191 has fallen below the user adjusted thrust pressure limit 195, causing the thrust pressure limit 195 to be further incremented by the controller.

Figure 13:
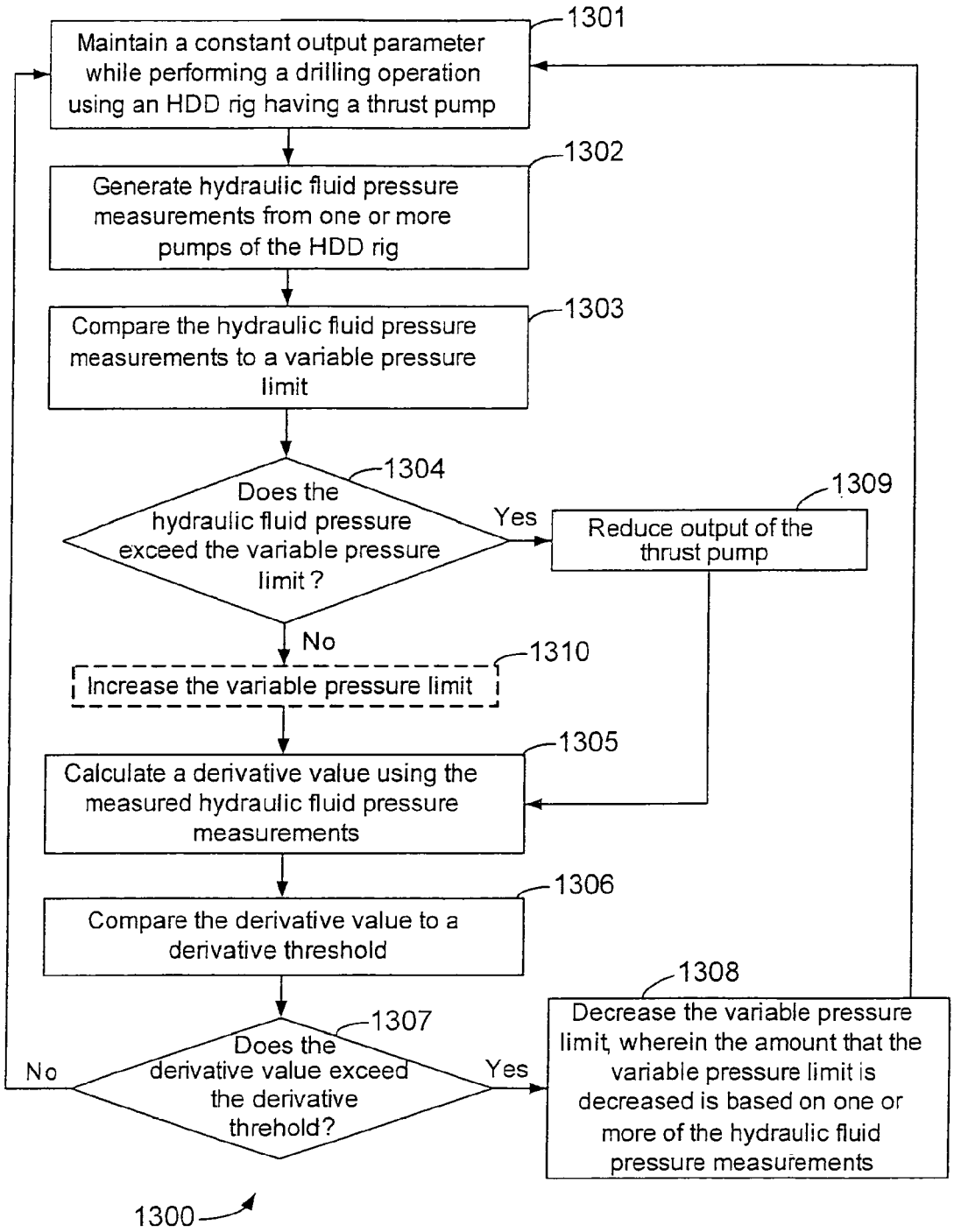
FIG. 13 is a logical flow diagram of an embodiment that implements a constant speed thrust pressure mode.

FIG. 13 illustrates a method 1300 for constant-mode autodrilling with pressure derivative control. The method 1300 can be performed using the structure and embodiments discussed herein. The method 1300 includes maintaining 1301 a constant output parameter while performing a drilling operation using an HDD rig having a thrust pump. The parameter can be maintained as part of an autodrilling function selected by a user.

The method can further include generating 1302 hydraulic fluid pressure measurements from one or more pumps of the HDD rig, and comparing 1303 the hydraulic fluid pressure measurements to a variable pressure limit. The hydraulic fluid pressure measurements can be taken and compared to the variable pressure limit continuously, periodically, or based on the detection of a condition. The one or more pumps from which the hydraulic fluid pressure measurements are taken can be one or more of a rotation pump and a thrust pump.

Based on the comparison 1303, it is determined 1304 whether the hydraulic fluid pressure exceeds the variable pressure limit. If the hydraulic fluid pressure exceeds the variable pressure limit, then the output of the thrust pump is reduced 1309. In either case, the method 1300 calculates 1305 a derivative value using the measured hydraulic fluid pressure measurements of step 1302.

The method 1300 may include increasing 1310 the variable pressure limit when it is determined 1304 that one or more of the hydraulic fluid pressure measurements are less than the variable pressure limit.

The calculated 1305 derivative value is compared 1306 to a derivative threshold. Based on the comparison 1306, it is determined 1307 whether the derivative value exceeds the derivative threshold. If the derivative value exceeds the derivative threshold, then the variable pressure limit is decreased 1308. The amount that the variable pressure limit is decreased can be based on one or more of the hydraulic fluid pressure measurements. In either case, the method continues to maintain 1301 the constant output parameter.

In some embodiments of the method 1300, decreasing 1308 the variable pressure limit further comprises decreasing 1308 the variable pressure limit to a value having a proportional relationship to one or more of the hydraulic fluid pressure measurements taken 1302 before the comparison of the hydraulic fluid pressure measurements to the variable pressure limit triggered the variable pressure limit decrease.

In some embodiments, the hydraulic fluid pressure measurements of step 1302 are stored in memory and a value to which the variable pressure limit is decreased 1308 when the derivative value exceeds the derivative threshold is similar or equal to a stored hydraulic fluid pressure measurement that was taken before the comparison 1306 of the derivative value to the derivative threshold indicated 1307 that the derivative value exceeded the derivative threshold thereby triggering the variable pressure limit decrease. The value to which the variable pressure limit is decreased 1308 may be equal to one of the hydraulic fluid pressure measurements that was taken 1302 before the comparison 1306 of the derivative value to the derivative threshold indicated 1307 that the derivative value exceeded the derivative threshold thereby triggering the variable pressure limit decrease 1308.

In some embodiments of the method 1300, two derivatives are calculated 1305 based on separate hydraulic fluid pressure measurements 1302 respectively taken before and after a time interval expires. In such embodiments, two derivatives are calculated 1305 and two comparisons 1306 are made between the derivative values and the derivative threshold, wherein the variable pressure limit is decreased 1308 only if both of the derivative values exceed the derivative threshold. In some embodiments, the first calculated derivative exceeding the derivative threshold triggers the time interval and the calculation of the second derivative.

In some embodiments of the method 1300, the variable pressure limit can be increased based on a user input.

In some embodiments of the method 1300, multiple derivatives are calculated 1305 based on separate hydraulic fluid pressure measurements 1302 respectively taken from a rotation pump and the thrust pump, wherein the decrease 1308 of the variable pressure limit could be based on either of two derivatives calculated 1308 from the respective pressure measurements exceeding 1307 the derivative threshold based on respective comparisons 1306.

In some embodiments of the method 1300, maintaining 1301 the constant output parameter may include adjusting respective outputs of the thrust pump and a rotation pump to maintain a constant linear advancement of a drill pipe, wherein the derivative value is calculated 1305 from one or both of hydraulic fluid pressure measurements taken 1302 from one or both of the rotation pump and the thrust pump.

In some embodiments of the method 1300, maintaining 1301 the constant output parameter includes adjusting the thrust pump output to maintain a constant thrust pressure and the hydraulic fluid pressure measurements are taken 1302 from a rotational pump.

In some embodiments of the method 1300, maintaining 1301 the constant output parameter includes adjusting the thrust pump output to maintain a constant rotation pressure and the hydraulic fluid pressure measurements are taken 1302 from the thrust pump.

Pressure can be measured using various types of pressure sensors, including piezoelectric and dynamic resistance based sensors.

In some of the above embodiments, program instructions stored in memory may be executed by a processor to cause a HDD system to perform the stated processes/methods.

While particular embodiments of the invention have been described with respect to its application, it will be understood by those skilled in the an that the invention is not limited by such application or embodiment or the particular components disclosed and described herein. It will be appreciated by those skilled in the art that other components that embody the principles of this invention and other applications therefore other than as described herein can be configured within the spirit and intent of this invention. The arrangement described herein is provided as only one example of an embodiment that incorporates and practices the principles of this invention.

What is claimed is:

1. An horizontal directional drilling (HDD) system having one or more automatic drilling modes, comprising:

a drill pipe configured to attach to a boring tool;

a thrust pump configured to linearly advance the drill pipe;

a rotation pump configured to rotate the drill pipe;

one or more pressure sensors configured to measure hydraulic fluid pressure; and a controller coupled to the thrust pump and pressure sensor, the controller configured to execute program instructions stored in memory to cause the HDD system to:

perform drilling operations in a constant parameter mode in which an output parameter is maintained at a constant level;

compare the hydraulic fluid pressure measurements to a variable pressure limit while the HDD system is operating in the constant parameter mode;

calculate a derivative value of the hydraulic fluid pressure measurements and compare the derivative value to a derivative threshold;

decrease the variable pressure limit if the derivative value exceeds the derivative threshold, wherein the amount that the variable pressure limit is decreased is based on one or more of the hydraulic fluid pressure measurements; and reduce output of the thrust pump when the comparison of the hydraulic fluid pressure measurements to the variable pressure limit indicates that one or more of the hydraulic fluid pressure measurements exceed the variable pressure limit.

2. The HDD system of claim 1, wherein the controller is further configured to store the hydraulic fluid pressure measurements in the memory and decrease the variable pressure limit to a value that is similar or equal to a hydraulic fluid pressure value that was measured and stored before the derivative value exceeded the derivative threshold thereby triggering the variable pressure limit decrease.

3. The HDD system of claim 1, wherein a value to which the variable pressure limit is decreased is equal to a most recent hydraulic fluid pressure measurement of the hydraulic fluid pressure measurements that was measured by the one or more pressure sensors before the derivative value exceeded the derivative threshold thereby triggering the variable pressure limit decrease.

4. The HDD system of claim 1, wherein the controller is further configured to increase the variable pressure limit when one or more of the hydraulic fluid pressure measurements are less than the variable pressure limit.

5. The HDD system of claim 1, wherein the controller is further configured to:

initiate a time interval if the derivative value exceeds the derivative threshold;

calculate an additional derivative value of the hydraulic fluid pressure measurements based on one or more hydraulic fluid pressure measurements taken after the time interval expires;

compare the additional derivative value to the derivative threshold; and decrease the variable pressure limit if the additional derivative value exceeds the derivative threshold.

6. The HDD system of claim 1, further comprising a user interface, wherein the controller is further configured to increase the variable pressure limit based on information received from the user interface.

7. The HDD system of claim 1, wherein at least one of the one or more pressure sensors is configured to measure hydraulic fluid pressure of the rotation pump and the calculation of the derivative value of the hydraulic fluid pressure measurements is based on hydraulic fluid pressure measurements taken from the rotation pump.

8. The HDD system of claim 1, wherein at least one of the one or more pressure sensors is configured to measure hydraulic fluid pressure of the thrust pump and the calculation of the derivative value of the hydraulic fluid pressure measurements is based on hydraulic fluid pressure measurements taken from the thrust pump.

9. The HDD system of claim 1, wherein a first pressure sensor of the one or more pressure sensors is configured to measure hydraulic fluid pressure of the rotation pump, a second pressure sensor of the one or more pressure sensors is configured to measure hydraulic fluid pressure of the thrust pump, and the decrease of the variable pressure limit is based on one or more derivative values calculated from hydraulic fluid pressure measurements taken by one or both of first pressure sensor and the second pressure sensor.

10. The HDD system of claim 1, wherein the controller is further configured to decrease the variable pressure limit to a value having a proportional relationship relative to one of the hydraulic fluid pressure measurements that was taken by one of the pressure sensors before the derivative value exceeded the derivative threshold thereby triggering the variable pressure limit decrease.

11. The HDD system of claim 1, wherein the controller is configured to maintain a constant linear advancement of the drill pipe in the constant parameter mode and the derivative value is calculated from one or both of rotation pump hydraulic fluid pressure and thrust pump hydraulic fluid pressure as sensed by the one or more pressure sensors.

12. The HDD system of claim 1, wherein the controller is configured to maintain a constant thrust pressure in the constant parameter mode and the derivative value is calculated from rotation pump hydraulic fluid pressure as sensed by the one or more pressure sensors.

13. The HDD system of claim 1, wherein the controller is configured to maintain a constant rotation pressure of the rotation pump in the constant parameter mode and the derivative value is calculated from thrust pump hydraulic fluid pressure as sensed by the one or more pressure sensors.

14. A method of horizontal directional drilling (HDD) in an automatic drilling mode, comprising:

maintaining a constant output parameter while performing a drilling operation using an HDD rig having a thrust pump;

generating hydraulic fluid pressure measurements from one or more pumps of the HDD rig;

comparing the hydraulic fluid pressure measurements to a variable pressure limit;

calculating a derivative value using the measured hydraulic fluid pressure measurements;

comparing the derivative value to a derivative threshold;

decreasing the variable pressure limit when the derivative value exceeds the derivative threshold, wherein the amount that the variable pressure limit is decreased is based on one or more of the hydraulic fluid pressure measurements; and reducing output of the thrust pump when the comparison of the hydraulic fluid pressure measurements to the variable pressure limit indicates that one or more of the hydraulic fluid pressure measurements exceed the variable pressure limit.

15. The method of claim 14, further comprising storing the hydraulic fluid pressure measurements in memory, wherein a value to which the variable pressure limit is decreased when the derivative value exceeds the derivative threshold is similar or equal to a stored hydraulic fluid pressure measurement that was taken before the comparison of the derivative value to the derivative threshold indicated that the derivative value exceeded the derivative threshold thereby triggering the variable pressure limit decrease.

16. The method of claim 14, wherein a value to which the variable pressure limit is decreased is equal to one of the hydraulic fluid pressure measurements that was taken before the comparison of the derivative value to the derivative threshold indicated that the derivative value exceeded the derivative threshold thereby triggering the variable pressure limit decrease.

17. The method of claim 14, further comprising increasing the variable pressure limit when one or more of the hydraulic fluid pressure measurements are less than the variable pressure limit.

18. The method of claim 14, further comprising:

initiating a time interval when the derivative value exceeds the derivative threshold;

calculating an additional derivative value using the measured hydraulic fluid pressure measurements taken after the time interval expires;

comparing the additional derivative value to the derivative threshold; and decreasing the variable pressure limit if the additional derivative exceeds the derivative threshold.

19. The method of claim 14, further comprising increasing the variable pressure limit based on user input.

20. The method of claim 14, wherein the one or more pumps from which the hydraulic fluid pressure measurements are taken is a rotation pump of the HDD rig.

21. The method of claim 14, wherein the one or more pumps from which the hydraulic fluid pressure measurements are taken is the thrust pump of the HDD rig.

22. The method of claim 14, wherein the one or more pumps from which the hydraulic fluid pressure measurements are taken is the thrust pump and a rotation pump of the HDD rig and the decrease of the variable pressure limit is based on one or more derivatives values calculated from fluid pressure measurements taken from one or both of the thrust pump and the rotation pump.

23. The method of claim 14, wherein decreasing the variable pressure limit further comprises decreasing the variable pressure limit to a value having a proportional relationship to one or more of the hydraulic fluid pressure measurements taken before the comparison of the derivative value to the derivative threshold triggered the variable pressure limit decrease.

24. The method of claim 14, wherein maintaining the constant output parameter further comprises adjusting respective outputs of the thrust pump and a rotation pump to maintain a constant linear advancement of a drill pipe and wherein the derivative value is calculated from one or both of hydraulic fluid pressure measurements taken from one or both of the rotation pump and the thrust pump.

25. The method of claim 14, wherein maintaining the constant output parameter further comprises adjusting the thrust pump output to maintain a constant thrust pressure and the hydraulic fluid pressure measurements are taken from a rotational pump.

26. The method of claim 14, wherein maintaining the constant output parameter further comprises adjusting the thrust pump output to maintain a constant rotation pressure and the hydraulic fluid pressure measurements are taken from the thrust pump.

27. A horizontal directional drilling (HDD) system configured to operate in an automatic drilling mode, comprising:

means for maintaining a constant output parameter while performing a drilling operation using an HDD rig having a thrust pump;

means for generating hydraulic fluid pressure measurements from one or more pumps of the HDD rig;

means for comparing the hydraulic fluid pressure measurements to a variable pressure limit;

means for calculating a derivative value using the measured hydraulic fluid pressure measurements;

means for comparing the derivative value to a derivative threshold;

means for decreasing the variable pressure limit when the derivative value exceeds the derivative threshold, the amount that the variable pressure limit is decreased based on one or more of the hydraulic fluid pressure measurements; and means for reducing output of the thrust pump when the comparison of the hydraulic fluid pressure measurements to the variable pressure limit indicates that one or more of the hydraulic fluid pressure measurements exceed the variable pressure limit.

28. The system of claim 27, wherein a value to which the variable pressure limit is decreased when the derivative value exceeds the derivative threshold is equal to one of the hydraulic fluid pressure measurements that was generated before the comparison of the derivative value to the derivative threshold indicated that the derivative value exceeded the derivative threshold thereby triggering the variable pressure limit decrease.

* * * * *